US006882116B2

(12) United States Patent
Araki

(10) Patent No.: US 6,882,116 B2
(45) Date of Patent: Apr. 19, 2005

(54) DRIVING METHOD FOR PLASMA DISPLAY PANEL

(75) Inventor: Kota Araki, Tokyo (JP)

(73) Assignee: NEC Plasma Display Corporation, Tokyo (JP)

( * ) Notice: Subject to any disclaimer, the term of this patent is extended or adjusted under 35 U.S.C. 154(b) by 0 days.

(21) Appl. No.: 10/712,999

(22) Filed: Nov. 17, 2003

(65) Prior Publication Data

US 2004/0108975 A1 Jun. 10, 2004

(30) Foreign Application Priority Data

Nov. 15, 2002 (JP) ..... 2002-332538

(51) Int. Cl.[7] ..... G09G 3/10
(52) U.S. Cl. ..... 315/169.4; 345/60
(58) Field of Search ..... 315/169.1, 169.4; 345/206, 60, 66–67

(56) References Cited

U.S. PATENT DOCUMENTS 6,023,258 A * 2/2000 Kuriyama et al. ..... 345/60
6,294,875 B1 * 9/2001 Kurata et al. ..... 315/169.1
6,603,447 B1 * 8/2003 Ito et al. ..... 345/60
6,707,436 B1 * 3/2004 Setoguchi et al. ..... 345/60
6,720,941 B1 * 4/2004 Kashio ..... 345/68
6,816,136 B1 * 11/2004 Tanaka et al. ..... 345/66
2002/0135542 A1 * 9/2002 Kim et al. ..... 345/50

FOREIGN PATENT DOCUMENTS

JP 2000-122602 A 4/2000
JP 2001-272948 A 10/2001

* cited by examiner

*Primary Examiner*—Thuy Vinh Tran
(74) *Attorney, Agent, or Firm*—Sughrue Mion, PLLC

(57) ABSTRACT

The method for driving a plasma display panel having a first substrate on which a plural of first electrodes and a plural of second electrodes are placed in parallel to each other, and a second substrate on which a plural of third electrodes placed so as to face the plurality of first and second electrodes and formed in a manner that the plurality of the third electrodes is extended in a direction orthogonal to the plurality of the first and second electrodes, the method including: a step of applying a voltage having an inclined waveform which changes with time to the first or second electrode; and a step of setting time of occurrence of discharge so that, in each of the display cells, time of occurrence of facing discharge between the first or second electrode to which the voltage having the inclined waveform is applied and the third electrode comes earlier than earliest time of occurrence of surface discharge between the first and second electrodes corresponding to each other.

27 Claims, 23 Drawing Sheets

DRIVING METHOD FOR PLASMA DISPLAY PANEL

BACKGROUND OF THE INVENTION

1. Field of the Invention

The present invention relates to a method for driving a plasma display panel (PDP) and more particularly to the method for driving a PDP which performs AC (Alternating Current)-type matrix display.

The present application claims priority of Japanese Patent Application No. 2002-332538 filed on Nov. 15, 2002, which is hereby incorporated by reference.

2. Description of the Related Art

A PDP is classified, from a structural point of view, into two types, one being a DC (Direct Current)-type PDP in which an electrode is exposed in a discharge gas and another being an AC-type PDP in which an electrode is covered by a dielectric and is not exposed directly in the discharge gas. Moreover, the AC-type PDP is further classified into a memory-operated type AC PDP which uses a memory function based on a charge accumulating action of a dielectric and a refresh-operated type AC PDP which does not use the memory function.

General configurations of the AC-type PDP and a conventional method for driving the same are described below.

FIG. 15 is an exploded perspective view illustrating configurations of a PDP 20, one of the conventional AC-type PDPs, disclosed in Japanese Patent Application Laid-open No. 2001-272948.

The PDP 20 has a front-side insulating substrate 1*a* and a rear-side insulating substrate 1*b*.

On the front-side insulating substrate 1*a* are arranged a plurality of scanning electrodes 9 and a plurality of sustaining electrodes 10 in parallel to each other in a manner that each of the scanning electrodes 9 pairs up with a corresponding one of the sustaining electrodes 10.

The scanning electrodes 9 and sustaining electrodes 10 each are made up of a bus electrode 3 adapted to ensure electrical conductivity and a main discharge electrode 2 to cause discharge to occur. In the PDP shown in FIG. 15, as the main discharge electrode 2, a transparent electrode made of ITO (Indium Tin Oxide) or $SnO_2$ (Tin Dioxide) is used not to cause transmittance to be lowered. The scanning electrode 9 and sustaining electrode 10 are covered by a dielectric layer 4*a*. A protecting film 5 made of magnesium oxide or a like is deposited on the dielectric layer 4*a* to protect the dielectric layer 4*a* from damages caused by discharge.

On the rear-side insulating substrate 1*b*, a plurality of data electrodes 6 are arranged in a manner that each of the data electrodes 6 intersects each of a plurality of pairs of the scanning electrodes 9 and the sustaining electrodes 10 at right angles.

The data electrode 6 is covered by a dielectric layer 4*b*. On the dielectric layer 4*b* is formed a plurality of ribs 7 to secure discharge space and to partition a cell.

On a surface of the dielectric layer 4*b* on which no ribs 7 are formed and on a side of each of the ribs 7 is applied a coating of a phosphor 8 used to convert an ultraviolet ray being produced by discharge to a visible light. By painting each discharging cell red (R), green (G), or blue (B) using the phosphor 8 (these red, green, and blue colors being called "three primary colors"), color display is made possible.

Space being put between the front-side insulating substrate la and the rear-side insulating substrate 1*b* and being partitioned off by the rib 7 is filled with a discharge gas in a sealed manner. As the discharge gas, for example, helium, neon, or xenon, or a mixed gas of these gases is used.

FIG. 16 is a plan view illustrating a PDP 20 of FIG. 15 viewed from a side of a display surface.

As shown in FIG. 16, the scanning electrode 9 and the sustaining electrode 10 are arranged in parallel to each other in a row direction and in a manner that the scanning electrode 9 pairs up with the sustaining electrode 10. A gap occurring between the scanning electrode 9 and the sustaining electrode 10 is called a "discharge gap 12". In the discharge gap 12, horizontal discharge (surface discharge) occurs between the scanning electrode 9 and sustaining electrode 10.

Next, readiness of occurrence of discharge (discharging probability) is described.

To cause discharge occur between the electrodes within a cell, it is necessary to apply a voltage exceeding a discharge threshold value. Some time is required before discharge occurs since a voltage is applied between the electrodes. This time is called "discharge delay time".

This discharge delay time is determined as a value of probability based on various parameters of a PDP. Out of them, an important index includes a density such as charged particles, metastables, or a like within discharged space. These charged particles and metastables are called "priming particles" collectively. Occurrence of these particles increases readiness of occurrence of discharge, that is, discharge probability.

Next, discharging operations of a selected display cell are explained.

When a pulse voltage exceeding a discharge threshold value is applied between the scanning electrode 9 and the data electrode 6 within each display cell to cause discharge to be started, positive and negative charges are attracted, in a manner to correspond to a polarity of the pulse voltage, on surfaces of the dielectric layers 4*a* and 4*b*, thus causing charges to be accumulated. A polarity of an equivalent internal voltage caused by the accumulation of charges, that is, of a wall voltage becomes reverse to that of the pulse voltage. Due to this, as the discharge progresses, an effective voltage in the display cell is lowered and even if the pulse voltage is held at a specified level, discharge cannot be maintained and finally the discharge comes to stop.

When discharge occurs between the scanning electrode 9 and the data electrode 6, if a voltage being at a level being more than a specified level has been applied between the scanning electrode 9 and the sustaining electrode 10, discharge occurred between the scanning electrode 9 and the data electrode 6 triggers discharge to also occur between the scanning electrode 9 and the sustaining electrode 10 and, as in the case of discharge between the scanning electrode 9 and the data electrode 6, charges are accumulated on the dielectric layer 4*a* in a manner so as to counter voltages having been applied at that time with charges thereon.

When a sustaining discharge pulse being a pulse voltage having a same polarity as a wall charge is applied between the scanning electrode 9 and sustaining electrode 10, since the wall voltage is superimposed as an effective voltage on the sustaining discharge pulse, even if a voltage amplitude of the sustaining discharging pulse is small, the discharge threshold value is exceeded, as a result, causing discharge to occur. Therefore, by continuously and alternately applying a sustaining discharging pulse between the scanning electrode 9 and the sustaining electrode 10, discharge can be maintained. This function is called a "memory function".

Next, a method for driving a memory-operated AC-type PDP 20 is described by referring to FIG. 17. FIG. 17 is a voltage waveform diagram showing waveforms of voltages to be applied to various kinds of electrodes in the conventional method for driving the PDP 20.

A voltage is individually applied to each of the scanning electrodes 9 and the data electrodes 6 and a voltage having a same waveform is applied to all the sustaining electrodes 10. In FIG. 17, a mark "Si" shows a waveform of a voltage to be applied to a scanning electrode 9 to be scanned by the i-th scanning operation, a mark "C" shows a waveform of a voltage to be applied to the sustaining electrode 10, and a mark "Dj" shows a waveform of a voltage to be applied to the data electrode 6 placed in the j-th order.

As shown in FIG. 17, one period for a basic driving of a PDP is made up of an initializing period during which a state of a cell is initialized and the PDP is put in readiness for occurrence of discharge, a scanning period during which a cell to be used for display is selected, and a sustaining period during which the cell selected during the scanning period is made to be emitted.

First, during the initializing period, a sustaining discharge erasing pulse 30*a* is applied to all the scanning electrodes 9 to cause erasing discharge to occur in order to erase wall charges having been accumulated by the sustaining discharge pulse before then.

The erasing operation here represents not only erasing of all wall charges but also adjustment of amounts of wall charges to cause succeeding pre-discharge, writing discharge, and sustaining discharge to smoothly occur.

Then, a pre-discharging pulse 30*b* is applied to all the scanning electrodes 9 to cause discharge to forcedly occur in all the display cells and causes them to emit light due to discharge.

Furthermore, a pre-discharge erasing pulse 30*c* is applied to all the scanning electrodes 9 to cause erasing discharge to occur and to erase wall charges accumulated by application of the pre-discharging pulse 30*b*. The erasing operation here represents not only erasing of all wall charges but also adjustment of amounts of wall charges to cause succeeding writing discharge and sustaining discharge to smoothly occur.

The pre-discharge induced by the application of the pre-discharging pulse 30*b* and the erasing of the pre-discharge induced by the application of the pre-discharge erasing pulse 30*c* enable succeeding writing discharge to occur readily.

The pre-discharging pulse 30*b* and the pre-discharge erasing pulse 30*c* have an inclined waveform showing that the applied pulse voltage gradually changes (increases or decreases) with time. The discharge induced by the application of such the pulse having an inclined waveform leads to feeble discharge that spreads only in the vicinity of the discharge gap 12.

Since such the pre-discharge and the pre-discharge erasing discharge occur irrespective of an image to be displayed, light-emitting of a cell induced by such the discharge is observed as background luminance and a large value of the background luminance causes contrast to be lowered and image quality to be degraded.

FIG. 16 is a diagram illustrating one cell making up the PDP 20 shown in FIG. 15 and operations of the sustaining discharge erasing pulse 30*a* in a cross-sectional taken along the data electrode 6 of the cell (taken in a line A–A' shown in FIG. 16) are described by referring to FIG. 18 and FIGS. 19A to 19E. FIG. 18 is an expanded diagram showing a waveform of the sustaining discharge erasing pulse 30*a* being applied during a period from a sustaining period to a subsequent initializing period. FIGS. 19A to 19E are diagrams schematically illustrating arrangements of wall charges made when a sustaining discharge erasing pulse 30*a* is applied while feeble discharge occurs in a stable manner.

In the conventional method for driving the PDP 20, at a last time of sustaining discharge during the sustaining period, a voltage Vs is applied to the scanning electrode 9 and a potential of the sustaining electrode 10 is at a GND (ground) level.

Therefore, after termination of the sustaining discharge, immediately before the application of the sustaining discharge erasing pulse 30*a*, negative charges have been accumulated on the dielectric layer 4*a* above the scanning electrode 9 and positive charges on the dielectric layer 4*a* above the sustaining electrode 10. On the other hand, on the dielectric layer 4*b* above the data electrode 6 have been accumulated positive charges. FIG. 19A shows schematically an arrangement of such wall charges.

While the sustaining discharge erasing pulse 30*a* is being applied, the sustaining electrode 10 is held at a voltage Vs and a voltage having an inclined waveform which gradually changes with time from the voltage Vs toward a GND is being applied to the scanning electrode 9. After the voltage having the inclined waveform has been applied, when a sum of an externally applied voltage and a wall voltage exceeds a discharge initiating voltage, discharge occurs between the scanning electrode 9 and the sustaining electrode 10. Time at which the discharge starts is Tfsw shown in FIG. 18. When an amount of the change in the voltage having the inclined waveform becomes about 10 V/$\mu$s or less, the discharge becomes such a feeble discharge as gradually spreads with a change in potential (FIG. 19B).

Even at time Tfss shown in FIG. 18, feeble discharge occurs between the scanning electrode 9 and the sustaining electrode 10 (FIG. 19C).

Between the scanning electrode 9 and the data electrode 6, when a sum of an externally applied voltage and a wall voltage exceeds a discharge initiating voltage, vertical discharge (facing discharge) occurs with the data electrode 6 being at a positive potential level and with the scanning electrode 9 being at a negative potential level. Time at which the facing discharge starts is Tfm.

In this case, time Tfsw comes earlier than the time Tfm at which the facing discharge starts. That is, since surface discharge has occurred between the scanning electrode 9 and the sustaining electrode 10, discharge space is in a state where ions and/or metastables exist, that is, is put in an activated state. Therefore, the facing discharge between the scanning electrode 9 and the data electrode 6 occurs in a stable manner (FIG. 19D).

Then, after the application of the sustaining discharge erasing pulse 30*a*, charges are arranged in a manner as shown in FIG. 19E. That is, negative charges have been accumulated on the dielectric layer 4*a* above the scanning electrode 9 and positive charges on the dielectric layer 4*a* above the sustaining electrode 10. On the other hand, positive charges have been accumulated on the dielectric layer 4*b* above the data electrode 6. This enables a succeeding pre-discharging pulse to operate in a stable manner.

Next, operations of the pre-discharge erasing pulse 30*c* are described by referring to FIG. 21 and FIGS. 22A to 22D.

FIG. 21 is an expanded waveform diagram of the pre-discharging pulse 30*b* and the pre-discharge erasing pulse 30*c*. FIGS. 22A to 22D are diagrams schematically illustrating arrangements of wall charges made during an initializing period.

While the pre-discharging pulse 30*b* is being applied, a voltage having the inclined waveform and a positive polarity is applied to the scanning electrode 9 and the sustaining electrode 10 is held at a GND level.

When a sum of an externally applied voltage and a wall voltage exceeds a discharge initiating voltage, surface discharge occurs between the scanning electrode 9 and the sustaining electrode 10. The surface discharge occurring in this case is, as in the case of discharge occurring by the application of the sustaining discharge erasing pulse 30*a*, such feeble discharge as gradually spreads as a potential changes. This discharge causes charges existing in the vicinity of the discharge gap 12 to be adjusted. At this point, discharge occurs also between the scanning electrode 9 and the data electrode 6, as a result, causing positive charges to be accumulated on the dielectric layer 4*b* above the data electrode 6.

After the termination of the application of the pre-discharging pulse 30*b*, as shown in FIG. 22A, wall charges are arranged in a manner that negative charges have been accumulated on the dielectric layer 4*a* above the scanning electrode 9, positive charges on the dielectric layer 4*a* (exactly on the protecting film 5) above the sustaining electrode 10, and positive charges on the dielectric layer 4*b* (exactly on the phosphor 8) above the data electrode 6.

At time of application of the succeeding pre-discharge erasing pulse 30*c*, a voltage having the inclined waveform is applied to the scanning electrode 9 and the sustaining electrode 10 is held at a voltage Vs.

After the voltage having the inclined waveform has been applied, when a sum of an externally applied voltage and a wall voltage exceeds a discharge initiating voltage, surface discharge occurs between the scanning electrode 9 and the sustaining electrode 10. Time at which the surface discharge occurs is Tfsw shown in FIG. 21. The surface discharge occurring in this case is such feeble discharge as gradually spreads as a potential changes (FIG. 22B).

When a sum of an externally applied voltage and a wall voltage exceeds a discharge initiating voltage, facing discharge occurs between the scanning electrode 9 and the data electrode 6. Time at which the facing discharge occurs is Tfm shown in FIG. 21.

Even at time Tfss shown in FIG. 21, feeble discharge occurs between the scanning electrode 9 and the sustaining electrode 10.

In this case, time Tfsw comes earlier than the time Tfm at which the facing discharge starts. That is, surface discharge has already occurred between the scanning electrode 9 and the sustaining electrode 10 (FIG. 22C).

After the pre-discharge erasing pulse 30*c* has been applied, charges are arranged in a manner that operations during a succeeding scanning period are smoothly performed (FIG. 22D). Negative charges have been accumulated on the dielectric layer 4*a* above the scanning electrode 9, positive charges on the dielectric layer 4*a* above the sustaining electrode 10, and positive charges on the dielectric layer 4*b* on the data electrode 6.

In the scanning period during which discharge is caused to occur to select a cell for displaying, a scanning pulse is sequentially applied to each of the scanning electrodes 9 by deviating timing with which the scanning pulse is applied and a data pulse having a voltage of Vd is applied to the data electrode 6 according to displayed data with timing with which the scanning pulse is applied. In a cell to which the data pulse is applied at time of application of the scanning pulse, facing discharge occurs between the scanning electrode 9 and the data electrode 6 and surface discharge occurs, by being induced by the facing discharge, also between the scanning electrode 9 and the sustaining electrode 10. A series of these operations is called "writing discharge".

When writing discharge occurs, positive charges are accumulated on the dielectric layer 4*a* above the scanning electrode 9, negative charges on the dielectric layer 4*a* above the sustaining electrode 10, and negative charges on the dielectric charges 4*b* above the data electrode 6.

During the sustaining period, when writing discharge occurs during the scanning period and a voltage produced by a charge accumulated on the dielectric layer 4*a* is superimposed on a sustaining voltage, surface discharge occurs between the scanning electrode 9 and the sustaining electrode 10.

When, during the scanning period, no writing discharge occurs and wall charges are not generated on the dielectric layer 4*a*, the sustaining voltage is set so as to be a voltage not exceeding a discharge initiating voltage that induces surface discharge.

Therefore, only in a cell selected during the scanning period, sustaining discharge for displaying occurs.

When the first sustaining discharge occurs by application of the first sustaining pulse, negative charges are accumulated on the dielectric layer 4*a* above the scanning electrode 9 and positive charges on the dielectric layer 4*a* above the sustaining electrode 10. Since a polarity of a voltage of the second sustaining pulse to be applied to the scanning electrode 9 and sustaining electrode 10 has been reversed, unlike in the case of the voltage of the first sustaining pulse, a voltage produced by charges accumulated on the dielectric layer 4*a* is superimposed on the voltage of the second sustaining pulse and, as a result, the second discharge occurs by application of the second sustaining pulse.

Thereafter, the sustaining discharge is maintained in the same manner as above. If surface discharge does not occur by application of the first sustaining pulse, no discharge occurs by any sustaining pulse being applied thereafter.

The three periods including the initiating period, scanning period, and sustaining period described above are called a "sub-field" as a whole.

Moreover, to realize gray-level display, one field being a field required for displaying one screen is divided into a plurality of sub-fields and the number of sustaining pulses to be output in each sub-field is made different. If one field is divided into "n" pieces of sub-fields and luminance ratio in each sub-field is set to be $2^{(n-1)}$, by selecting sub-fields used for displaying in one field and combining them, gray-level display in $2^n$ ways is made possible.

For example, when one field is divided into 8 sub-fields, $2^8=256$, that is, by an ON/OFF switching for each of the 8 sub-fields, 256 gray-levels can be displayed.

However, the conventional method for driving the PDP described above has problems in that, when a voltage having the inclined waveform which gradually changes with time is applied, no feeble discharge occurs and when the voltage having the inclined waveform has exceeded a voltage at which feeble discharge has to occur, intense discharge occurs in some cases.

FIG. 23B shows lines of electric force representing states of an electric field between the scanning electrode 9 and the sustaining electrode 10. Reasons for the above problems are explained by referring to FIG. 23B.

The electric field between the scanning electrode 9 and the sustaining electrode 10, as shown by lines of electric force in FIG. 23B, is bending with the discharge gap 12 being centered. Due to this, an electric field in a position being far from the discharge gap 12 is in a comparatively non-dense state and an electric field in the vicinity of the discharge gap 12 is in a greatly dense state. Therefore, in the discharge gap 12, a very intense electric field is locally generated.

FIGS. 20A to 20E are diagrams schematically illustrating arrangements of wall charges produced during the initializing period during which intense discharge occurs.

In the conventional method for driving the PDP 20, at last time of sustaining discharge during the sustaining period, a voltage Vs is applied to the scanning electrode 9 and the sustaining electrode 10 is at a GND level.

Therefore, after termination of the sustaining discharge, immediately before the application of the sustaining discharge erasing pulse 30*a*, negative charges have been accumulated on the dielectric layer 4*a* above the scanning electrode 9 and positive charges on the dielectric layer 4*a* above the sustaining electrode 10. On the other hand, positive charges have been accumulated on the dielectric layer 4*b* above the data electrode 6 (FIG. 20A).

At the application of the sustaining discharge erasing pulse 30*a*, when occurrence probability of discharge has become low, there is a case in which surface discharge occurs accidentally at time being later than the time Tfsw, not at time Tfsw (FIG. 20B).

If the discharge occurs at the time being later than the time Tfsw, since an electric potential having the inclined waveform is lowered during the period, a potential difference being higher than the discharge initiating voltage is applied between the scanning electrode 9 and the sustaining electrode 10 and, at time of occurrence of the discharge, a range in which the discharge spreads becomes larger than a range in which feeble discharge spreads and, as a result, the discharge becomes somewhat large in scale.

As described above, since a very strong electric field exists in the discharge gap 12 between the scanning electrode 9 and the sustaining electrode 10, if large-scaled discharge occurs, the discharge rapidly progresses, leading to intense discharge that may spread all over a cell (FIG. 20C).

The time Tfss shown in FIG. 18 represents the earliest time at which such the intense discharge occurs.

Once intense discharge has occurred, positive charges are accumulated all over regions of the dielectric layer 4*a* above the scanning electrode 9 and negative charges are accumulated all over regions of the dielectric layer 4*a* above the sustaining electrode 10 (FIG. 20D).

Thereafter, since no discharge occurs while a voltage having the inclined waveform is being applied, after the application of the sustaining discharge erasing pulse 30*a*, wall charges are arranged in a manner as shown in FIG. 20E. That is, though positive charges have been accumulated on the dielectric layer 4*b* above the data electrode 6, unlike in the case of arrangements of wall charges shown in FIG. 19E, positive charges have been accumulated on the dielectric layer 4*a* above the scanning electrode 9 and negative charges on the dielectric layer 4*a* above the sustaining electrode 10.

A process of adjusting wall charges is executed by application of the pre-discharging pulse 30*b* and pre-discharge erasing pulse 30*c* after application of the sustaining discharge erasing pulse 30*a*, and the adjustment of wall charges by application of these two kinds of pulses including the pre-discharging pulse 30*b* and pre-discharge erasing pulse 30*c* is achieved, as in the case of the sustaining discharge erasing pulse 30*a*, by causing feeble discharge to occur. Due to this, though, in the vicinity of the discharge gap 12, an influence exerted by the intense discharge occurring at time of the application of the sustaining discharge erasing pulse 30*a* can be cancelled out, the influence exerted on all over the cell cannot be cancelled out and, as a result, in a position being far from the discharge gap 12 in the cell, positive charges remain accumulated on the dielectric layer 4*a* above the scanning electrode 9 and negative charges remain accumulated on the dielectric layer 4*a* above the sustaining electrode 10 (FIG. 20E).

During a succeeding scanning period, a voltage has been set so that a PDP operates in a stable manner when negative charges have been accumulated on the dielectric layer 4*a* above the scanning electrode 9 and positive charges on the dielectric layer 4*a* above the sustaining electrode 10 (FIG. 19E). Therefore, if positive charges have been accumulated on the dielectric layer 4*a* above the scanning electrode 9 and negative charges on the dielectric layer 4*a* above the sustaining electrode 10, operations of the PDP become unstable.

Moreover, in order to reduce background luminance, in some sub-fields, the pre-discharging pulse 30*b* and pre-discharge erasing pulse 30*c* are not used. This is because, ever after the charge adjustment has been made by the application of the sustaining discharge erasing pulse 30*a*, wall charges can be arranged in almost the same manner as arranged after application of the pre-discharge erasing pulse 30*c*. Therefore, as in the case where the pre-discharging pulse 30*b* and pre-discharge erasing pulse 30*c* are applied, operations of the PDP become stable in the succeeding scanning period.

However, if intense discharge occurs by the application of the sustaining discharge erasing pulse 30*a*, positive charges are accumulated on the dielectric layer 4*a* above the scanning electrode 9 and negative charges on the dielectric layer 4*a* above the sustaining electrode 10 (FIG. 20E), and since this states are succeeded in the scanning period, light emitting occurs in a cell having been not selected, that is, erroneous light emitting of the cell occurs.

To prevent such the erroneous light emitting of the cell, occurrence of intense discharge induced by the application of the sustaining discharge erasing pulse 30*a* must be avoided.

As in the case of the application of the sustaining discharge erasing pulse 30*a*, even when the pre-discharge erasing pulse 30*c* is applied, if discharge probability is low, in some cases, no feeble discharge occurs between the scanning electrode 9 and the sustaining electrode 10. If discharge occurs thereafter, since a potential difference being higher than a discharge initiating voltage has been applied, the discharge is changed to be somewhat more intense than feeble discharge. Since a very intense electric field exists in the discharge gap 12 between the scanning electrode 9 and the sustaining electrode 10, once intense discharge has occurred, the discharge rapidly progresses and becomes intense discharge that may spread all over the cell. The time Tfss shown in FIG. 21 represents the earliest time at which this intense discharge occurs.

Once this kind of intense discharge has occurred, positive charges are accumulated all over regions of the dielectric layer 4*a* above the scanning electrode 9 and negative charges are accumulated all over regions of the dielectric layer 4*a* above the sustaining electrode 10.

This arrangement of charges is the same as that appeared after writing discharge has occurred in a selected cell during the scanning period.

Due to this, even if a cell is not selected in a succeeding scanning period, when intense discharge has occurred by application of the pre-discharge erasing pulse 30*c*, discharge occurs since a wall voltage and externally applied voltage are superimposed when a first sustaining pulse 30*d* is applied, which causes discharge to continuously occur even when the sustaining pulse 30*d* is applied thereafter.

As a result, a state of light emitting occurs even in a cell having been not selected, that is, erroneous light emitting of the cell occurs. To prevent such the erroneous light emitting of a cell, occurrence of intense discharge by application of the pre-discharge erasing pulse 30*c* must be inhibited.

Thus, the conventional method for driving a PDP presents a problem in that, due to the state of erroneous light emitting of a cell, that is, due to the state in which a non-selected cell emits light, an original image quality is degraded.

To solve this problem, a method for driving a PDP being capable of solving such the problem of erroneous light emitting of a cell is disclosed in Japanese Patent Application Laid-open No. 2000-122602.

In the method for driving a PDP disclosed in the above application, occurrence time of surface discharge is separated from occurrence time of facing discharge.

However, this method has also a problem in that, if discharge occurs simultaneously, controlling of charges existing above the data electrode as desired becomes difficult, causing an operational failure to occur during the scanning period.

That is, if discharge probability is very low, when some time has elapsed after occurrence of discharge, priming particles rapidly decrease. Therefore, when the occurrence time of surface discharge is separated from occurrence time of facing discharge, which is employed in the driving method disclosed in the above application, even if facing discharge occurs first as feeble discharge, surface discharge subsequent to the facing discharge becomes intense discharge.

Thus, the disclosed method for driving a PDP cannot fully solve the problem of erroneous light emitting that a non-selected cell emits light due to occurrence of intense discharge.

SUMMARY OF THE INVENTION

In view of the above, it is an object of the present invention to provide a method for driving a PDP which is capable of making feeble discharge occur in a stable manner by application of a voltage having an inclined waveform which prevents erroneous light emitting of a cell caused by intense discharge that occurs accidentally, therefore, degradation in image quality can be prevented.

According to a first aspect of the present invention, there is provided a method for driving a plasma display panel having a first substrate on which a plural of first electrodes and a plural of second electrodes are placed in parallel to each other, a plurality of display lines each being formed between one of the first electrodes and corresponding one of the second electrodes, and a second substrate on which a plural of third electrodes placed so as to face the plurality of first and second electrodes and formed in a manner that the plurality of the third electrodes is extended in a direction orthogonal to the plurality of the first and second electrodes, and a plurality of display cell placed at points of intersection of the plurality of the third electrode and the plurality of the first and second electrodes, the method including:

a step of applying a voltage having an inclined waveform which changes with time to the first electrodes or/and the second electrodes; and a step of setting time of occurrence of discharge so that, in each of the display cells, time of occurrence of facing discharge between the first electrode or/and the second electrode to which the voltage having the inclined waveform is/are applied and the third electrode comes earlier than earliest time of occurrence of surface discharge between the first electrode and the second electrode corresponding to each other.

In the foregoing, a preferable mode is one wherein setting is done so that an electric potential of a pulse having the inclined waveform changes to become lower with time and an electric potential of the third electrode occurring when the pulse having the inclined waveform is applied is higher, for at least a partial period of time, than an electric potential of the third electrode occurring when a voltage of a pulse is applied before application of the voltage having the inclined waveform.

Also, a preferable mode is one wherein a negative bias voltage is applied to the third electrode when a voltage of a pulse is applied before application of the voltage having the inclined waveform.

Also, a preferable mode is one wherein, V(Tfsw), V(Tfm) and Vd2 (absolute value) are determined so that a following expression holds:

$$V(Tfsw)-V(Tfm)<Vd\mathbf{2}$$

where V(Tfsw) denotes a voltage to be applied to the first electrode at time when discharge between the first electrode and the second electrode is started, V(Tfm) denotes a voltage to be applied to the first electrode at time when discharge between the first electrode and the third electrode is started, and Vd2 denotes a negative bias voltage to be applied to the third electrode.

Also, a preferable mode is one wherein, V(Tfss), V(Tfm) and Vd2 (absolute value) are determined so that a following expression holds:

$$V(Tfss)-V(Tfm)<Vd\mathbf{2}$$

where V(Tfss) denotes a voltage to be applied to the first electrode at earliest time when intense discharge occurs, V(Tfm) denotes a voltage to be applied to the first electrode at time when discharge between the first electrode and the third electrode is started, and Vd2 denotes a negative bias voltage to be applied to the third electrode.

Another preferable mode is one wherein a positive bias voltage is applied to the third electrode while a voltage having the inclined waveform is being applied.

Atill another preferable mode is one wherein, V(Tfsw), V(Tfm) and Vd3 are determined so that a following expression holds:

$$V(Tfsw)-V(Tfm)<Vd\mathbf{3}$$

where V(Tfsw) denotes a voltage to be applied to the first electrode at time when discharge between the first electrode and the second electrode is started, V(Tfm) denotes a voltage to be applied to the first electrode at time when discharge between the first electrode and the third electrode is started, and Vd3 denotes a positive bias potential to be applied to the third electrode.

An additional preferable mode is one wherein the positive bias potential is applied at latest until time when the positive bias voltage reaches a voltage of start of discharge between the first electrode and the second electrode and, after that time, application of the positive bias voltage terminates.

A further preferable mode is one the positive bias potential is lowered after occurrence of discharge between the first electrode and the second electrode.

A still further preferable mode is one wherein the positive bias potential is at a same potential as a potential to be applied during a selection period during which displaying of a display cell is controlled.

Also, preferable mode is one that wherein further includes:

a step of setting a potential of the first electrode or the second electrode to which no voltage having the inclined waveform is applied so that a potential of the pulse having the inclined waveform to be applied to either of the first electrode or the second electrode changes to become lower with time and so that, start time of discharge between the first electrode and the second electrode, during a period while a voltage having the inclined waveform is being applied, comes later than start time of discharge between electrodes to which the voltage having the inclined waveform is applied and the third electrode.

Also, a preferable mode is one that wherein further includes a step of applying a voltage having the inclined waveform to the first electrode and a first voltage being lower than a voltage to be applied to the first electrode at last time of sustaining discharge to the second electrode.

Also, a preferable mode is one wherein, V(Tfsw), V(Tfm) and Vsb (absolute value) are determined so that a following expression holds:

$$V(Tfsw)-V(Tfm)<Vsb$$

where V(Tfsw) denotes a voltage to be applied to the first electrode at time when discharge between the first electrode and the second electrode is started, V(Tfm) denotes a voltage to be applied to the first electrode at time when discharge between the first electrode and the third electrode is started, and Vsb denotes a potential difference between a voltage to be applied to the first electrode at last time of sustaining discharge and the first voltage.

Also, a preferable mode is one wherein a voltage having the inclined waveform is applied to put the display cell into a non-display state after termination of a sustaining period during which light is emitted in the display cell.

Also, a preferable mode is one wherein a voltage having the inclined waveform is applied to erase wall charges accumulated by application of a pre-discharging pulse following application of the pre-discharging pulse used to cause discharge of all display cells to forcedly occur.

Another preferable mode is one wherein setting is done so that an electric potential of a pulse having the inclined waveform changes to become higher with time and an electric potential of the third electrode occurring when the pulse having the inclined waveform is applied is lower, for at least a partial period of time, than an electric potential of the third electrode occurring when a voltage of a pulse is applied before application of the voltage having the inclined waveform.

Still another preferable mode is one wherein a positive bias voltage is applied to the third electrode when a voltage of a pulse is applied before application of the voltage having the inclined waveform.

A further preferable mode is one wherein, V(Tfsw), V(Tfm) and Vd2 are determined so that a following expression holds:

$$|V(Tfsw)-V(Tfm)|<Vd2$$

where V(Tfsw) denotes a voltage to be applied to the first electrode at time when discharge between the first electrode and the second electrode is started, V(Tfm) denotes a voltage to be applied to the first electrode at time when discharge between the first electrode and the third electrode is started, and Vd2 denotes a positive bias voltage to be applied to the third electrode.

A still further preferable mode is one, V(Tfss), V(Tfm) and Vd2 are determined so that a following expression holds:

$$|V(Tfss)-V(Tfm)|<Vd2$$

where V(Tfss) denotes a voltage to be applied to the first electrode at earliest time when intense discharge occurs, V(Tfm) denotes a voltage to be applied to the first electrode at time when discharge between the first electrode and the third electrode is started, and Vd2 denotes a positive bias voltage to be applied to the third electrode.

Also, a preferable mode is one wherein a negative bias voltage is applied to the third electrode while a voltage having the inclined waveform is being applied.

Also, a preferable mode is one wherein, V(Tfsw), V(Tfm) and Vd3 are determined so that a following expression holds:

$$|V(Tfsw)-V(Tfm)|<Vd3$$

where V(Tfsw) denotes a voltage to be applied to the first electrode at time when discharge between the first electrode and the second electrode is started, V(Tfm) denotes a voltage to be applied to the first electrode at time when discharge between the first electrode and the third electrode is started, and Vd3 denotes a negative bias potential to be applied to the third electrode.

Also, a preferable mode is one wherein the negative bias potential is lowered after occurrence of discharge between the first electrode and the second electrode.

Also, a preferable mode is one wherein the negative bias potential is at a same potential as a potential to be applied during a selection period during which displaying of a display cell is controlled.

Also, a preferable mode is one that wherein further includes:

a step of setting a potential of the first electrode or the second electrode to which no voltage having the inclined waveform is applied so that a potential of the pulse having the inclined waveform to be applied to either of the first electrode or the second electrode changes to become higher with time and so that, start time of discharge between the first electrode and the second electrode, during a period while a voltage having the inclined waveform is being applied, comes later than start time of discharge between electrodes to which the voltage having the inclined waveform is applied and the third electrode.

Also, a preferable mode is one that wherein further includes a step of applying a voltage having the inclined waveform to the first electrode and a first voltage being higher than a voltage to be applied to the first electrode at last time of sustaining discharge to the second electrode.

Also, a preferable mode is one wherein, V(Tfsw), V(Tfm) and Vsb are determined so that a following expression holds:

$$|V(Tfsw)-V(Tfm)|<Vsb$$

where V(Tfsw) denotes a voltage to be applied to the first electrode at time when discharge between the first electrode and the second electrode is started, V(Tfm) denotes a voltage to be applied to the first electrode at time when discharge between the first electrode and the third electrode is started, and Vsb denotes a potential difference between a voltage to be applied to the first electrode at last time of sustaining discharge and the first voltage.

Also, a preferable mode is one wherein a voltage having the inclined waveform is applied to put the display cell into a non-display state after termination of a sustaining period during which light is emitted in the display cell.

With the above configurations, since feeble discharge occurs in a stable manner by application of a voltage having an inclined waveform that changes with time, occurrence of the intense discharge that occurs accidentally in the conventional method can be prevented. As a result, it is possible to prevent erroneous light emitting of a cell caused by the intense discharge. Also, since a pulse succeeding to a pulse having the inclined waveform can operate in a stable manner, degradation in image quality can be prevented.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
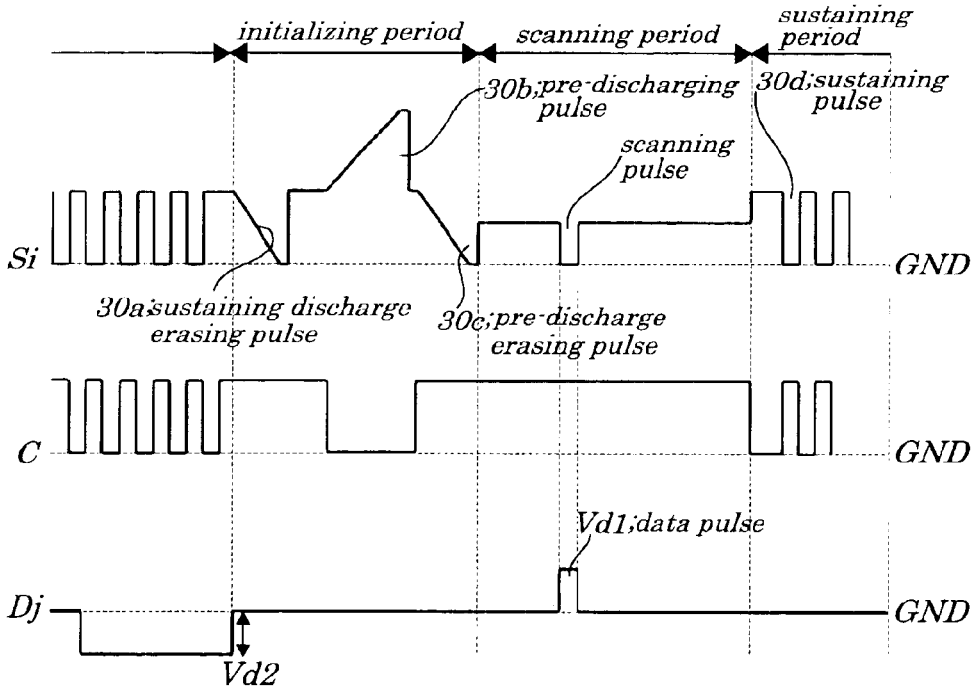
FIG. 1 is a voltage waveform diagram showing waveforms of a voltage to be applied to each electrode according to a method for driving a PDP of a first embodiment of the present invention.

A method for driving a PDP of a first embodiment of the present invention is described by referring to FIG. 1.

Figure 15:
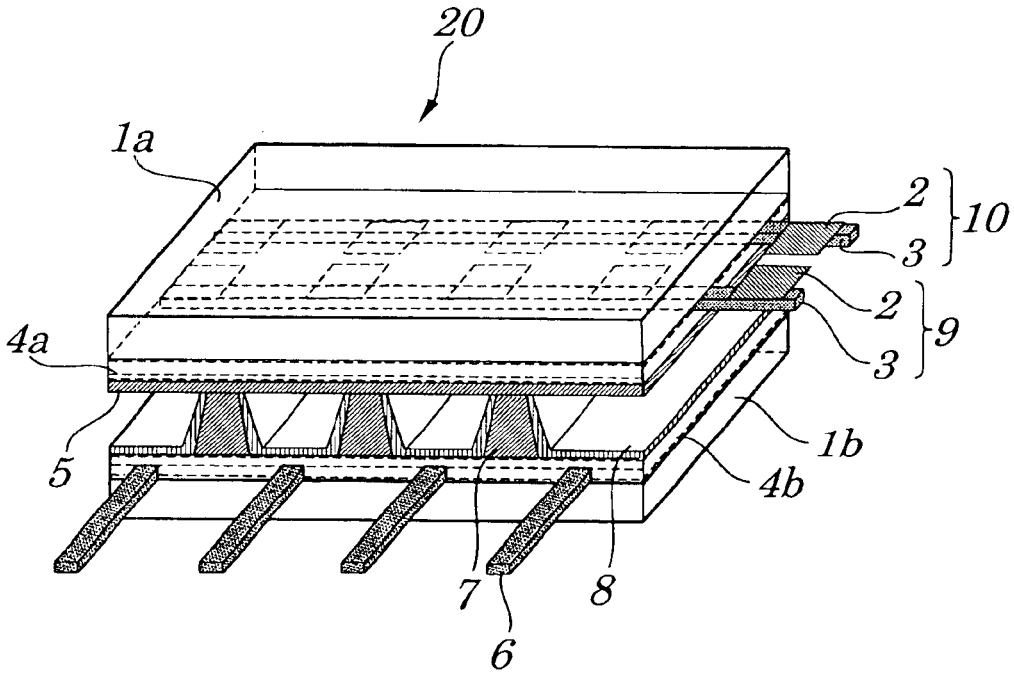
FIG. 15 (PRIOR ART)
FIG. 15 is an exploded perspective view of a PDP used in not only a conventional PDP driving method but also PDP driving methods according to respective embodiments of the present invention.
Figure 16:
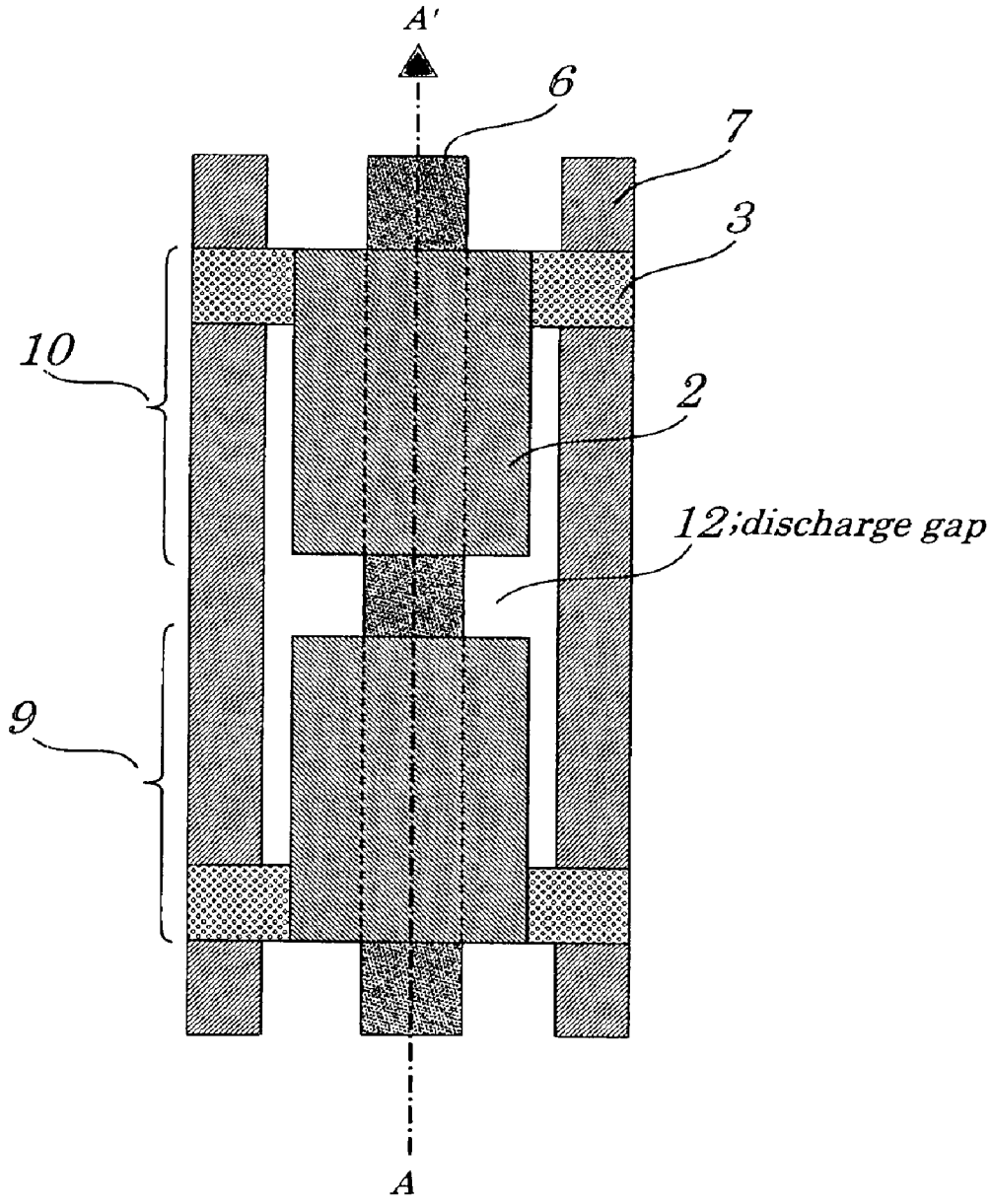
FIG. 16 (PRIOR ART)
FIG. 16 is a plan view illustrating the PDP used in the conventional method of FIG. 15 viewed from a side of a display surface.

A PDP used in the first embodiment has the same configurations as the PDP 20 used in the conventional method shown in FIG. 15.

FIG. 1 is a voltage waveform diagram showing waveforms of a voltage to be applied to each electrode according to the method for driving a PDP of the first embodiment. In FIG. 1, a mark "Si" shows a waveform of a voltage to be applied to a scanning electrode 9 to be scanned by the i-th scanning operation, a mark "C" shows a waveform of a voltage to be applied to a sustaining electrode 10, and a mark "Dj" shows a waveform of a voltage to be applied to a data electrode 6 placed in the j-th order.

As shown in FIG. 1, one basic period for driving a PDP includes an initializing period during which a state of a cell is initialized and the PDP is put in readiness for occurrence of discharge, a scanning period during which a cell to be used for display is selected, and a sustaining period during which the cell selected during the scanning period is made to be emitted.

The initializing period and the scanning period are the same as those employed in the conventional method for driving the PDP 20.

Though, during the sustaining period, a sustaining pulse 30*d* is applied to the scanning electrode 9 and the sustaining electrode 10 the number of times by which specified luminance is obtained, at time of starting application of 5 cycles of the sustaining pulse 30*d* immediately before the sustaining period terminates, a negative bias voltage of Vd2 is provided to the data electrode 6.

After this, the sustaining discharge erasing pulse 30*a* is again applied to put charges in an erased state.

Figure 17:
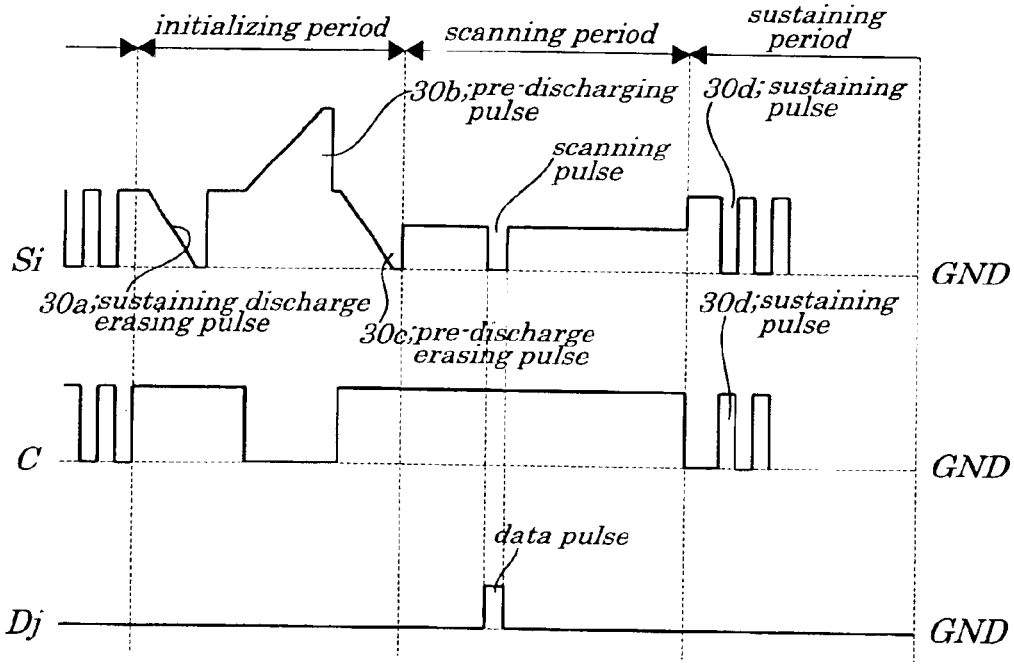
FIG. 17 (PRIOR ART)
FIG. 17 is a voltage waveform diagram showing waveforms of voltages to be applied to each electrode in the conventional method for driving the PDP.
Figure 18:
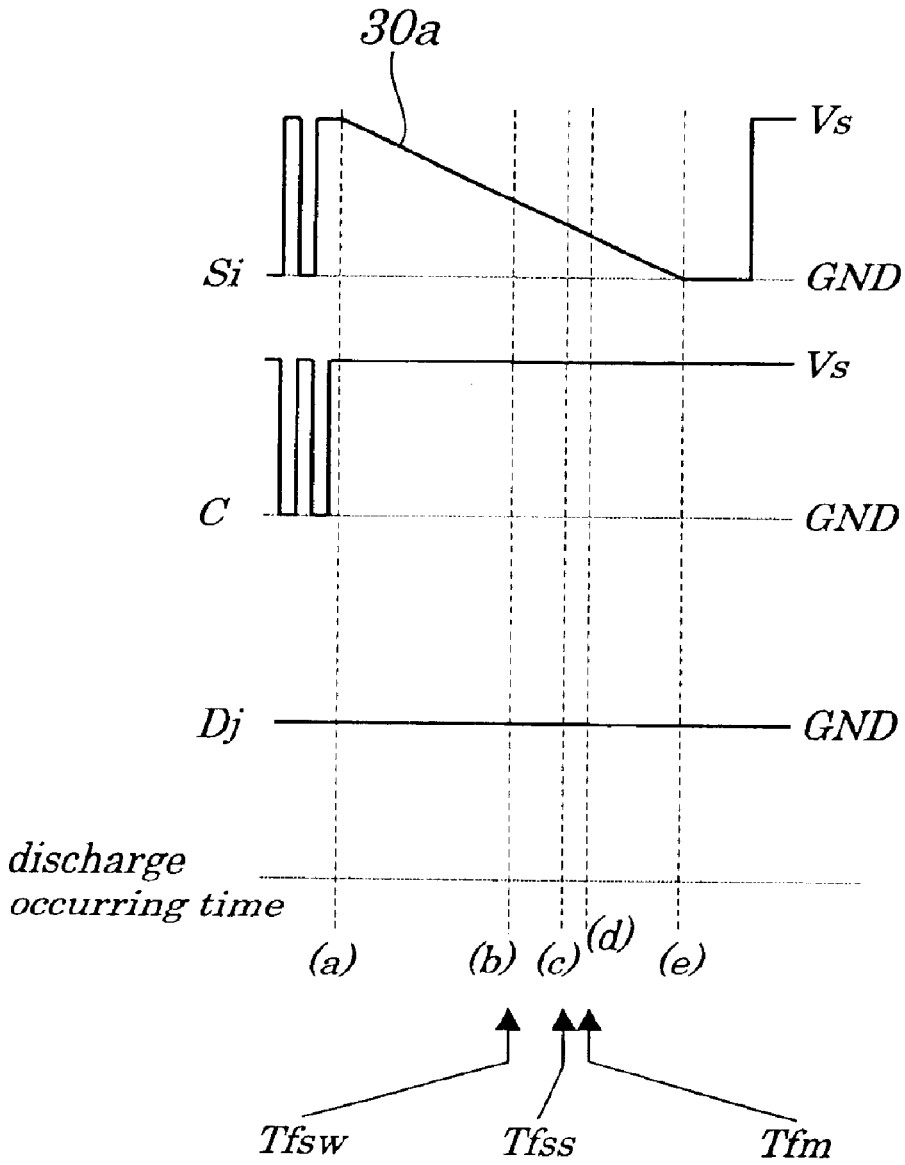
FIG. 18 (PRIOR ART)
FIG. 18 is a partially expanded diagram of the voltage waveform diagram of FIG. 17.
Figure 19A:
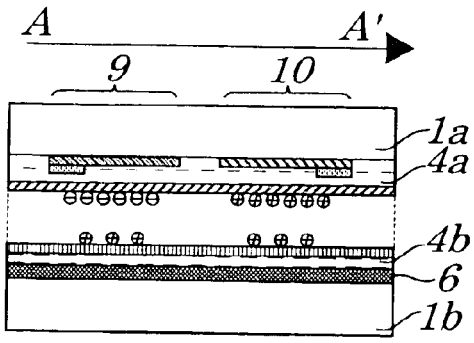
FIG. 19A (PRIOR ART)
FIGS. 19A to 19E are diagrams for illustrating states of discharge and arrangements of wall charge appearing while a sustaining discharge erasing pulse is being applied in the conventional method for driving the PDP.
Figure 19B:
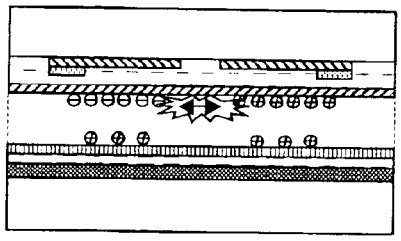
FIG. 19B (PRIOR ART)
Figure 19C:
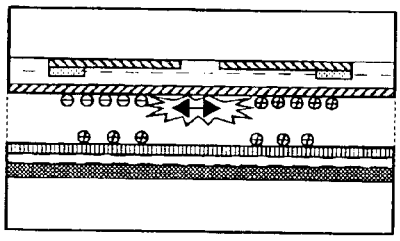
FIG. 19C (PRIOR ART)
Figure 19D:
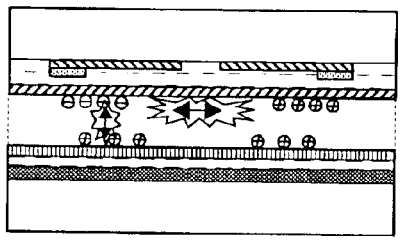
FIG. 19D (PRIOR ART)
Figure 19E:
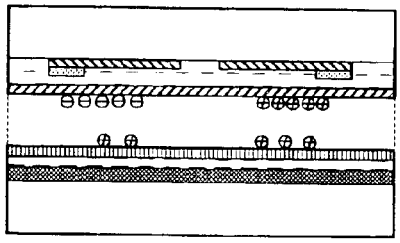
FIG. 19E (PRIOR ART)
Figure 20A:
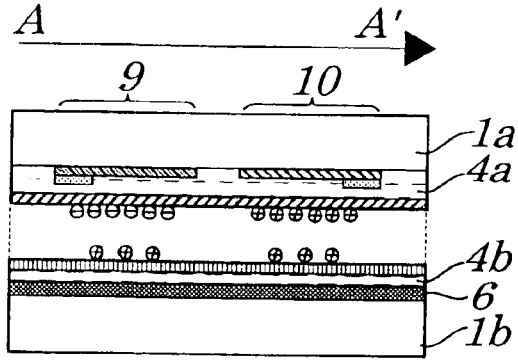
FIG.20A (PRIOR ART)
FIGS. 20A to 20E are diagrams for illustrating states of discharge and arrangements of wall charge appearing while a sustaining discharge erasing pulse is being applied in the conventional method for driving the PDP.
Figure 20B:
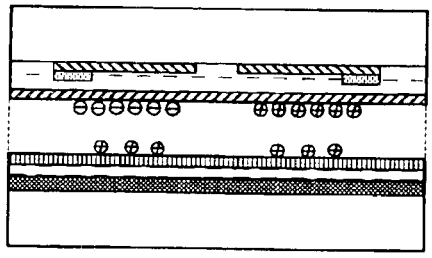
FIG20B (PRIOR ART)
Figure 20C:
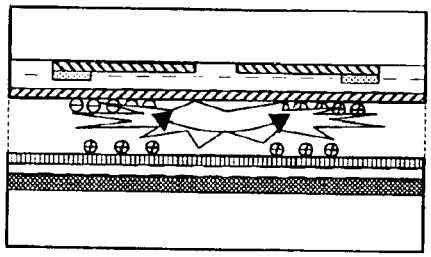
FIG.20C (PRIOR ART)
Figure 20D:
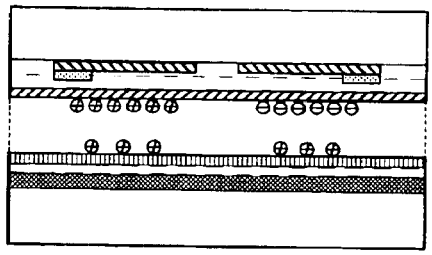
FIG.20D (PRIOR ART)
Figure 20E:
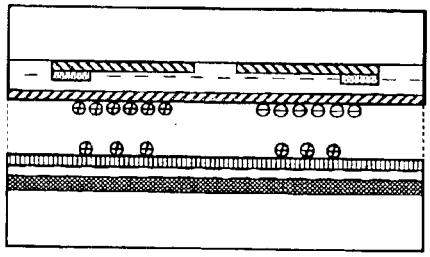
FIG.20E (PRIOR ART)
Figure 21:
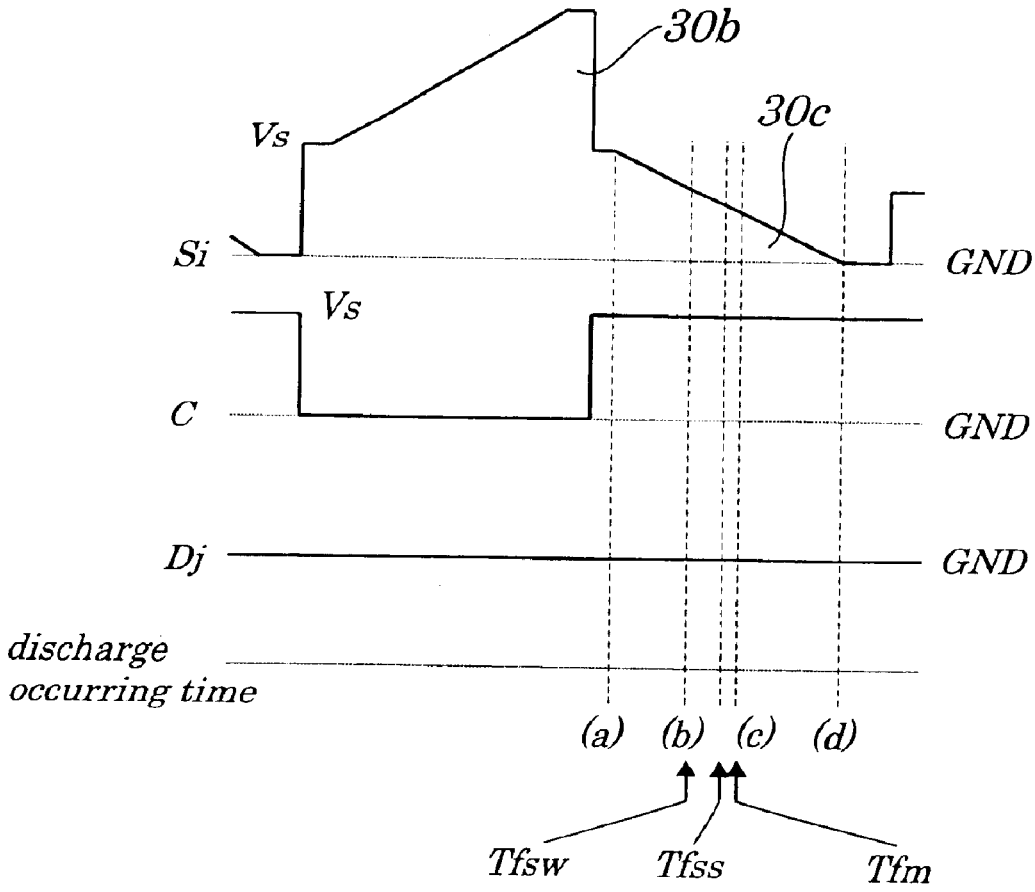
FIG.21 (PRIOR ART)
FIG. 21 is a partially expanded diagram of a pre-discharging pulse and a pre-discharge erasing pulse in the voltage waveform diagram shown in FIG. 17.
Figure 22A:
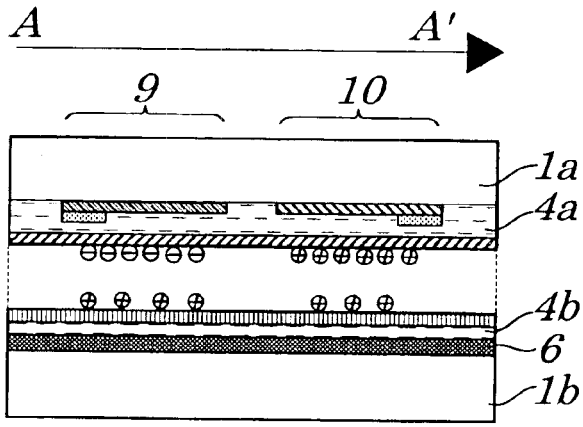
FIG.22A (PRIOR ART)
FIGS. 22A to 22D are diagrams for illustrating states of discharge and arrangements of wall charges appearing while a pre-discharge erasing pulse is being applied in the conventional method for driving the PDP.
Figure 22B:
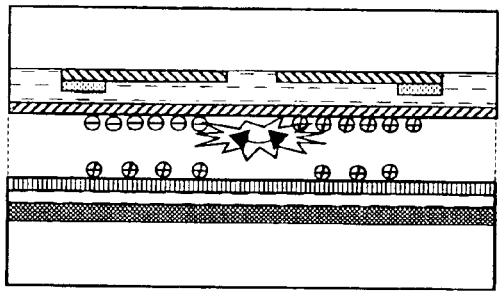
FIG.22B (PRIOR ART)
Figure 22C:
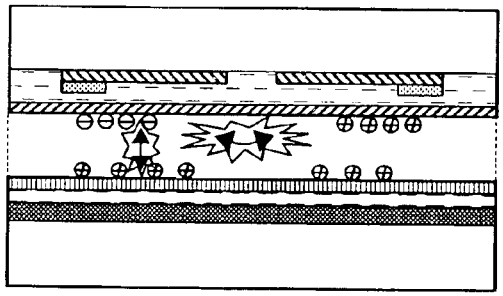
FIG.22C (PRIOR ART)
Figure 22D:
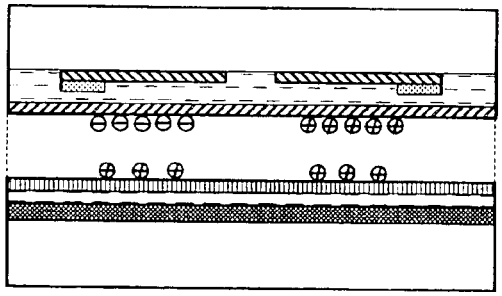
FIG.22D (PRIOR ART)

According to the method for driving a PDP of the present invention, degradation of image quality caused by erroneous light emitting of a cell can be more effectively prevented, compared with the conventional method for driving the PDP 20 shown in FIG. 17.

This is because erroneous arrangements of wall charges caused by intense discharge occurring accidentally can be prevented by stable occurrence of feeble discharge by application of the sustaining discharge erasing pulse 30*a*.

Figure 2:
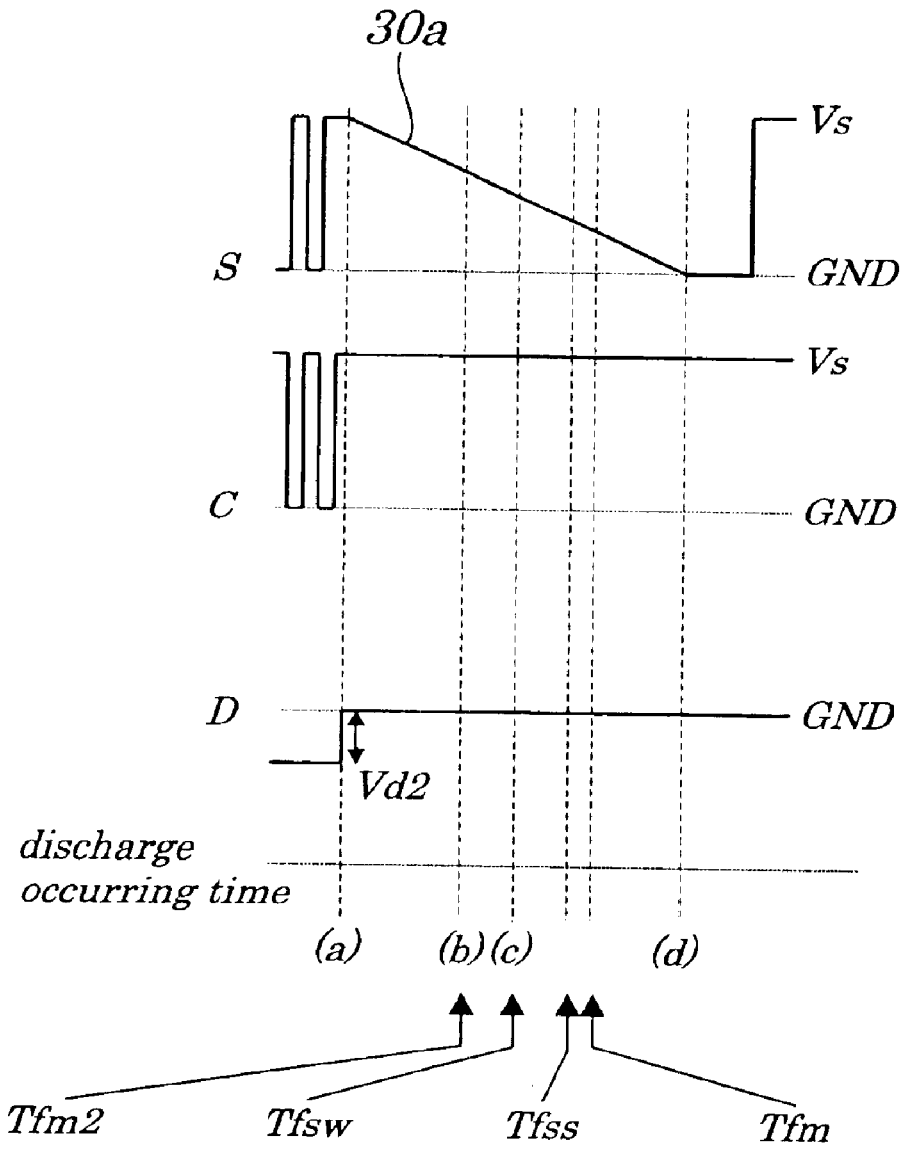
FIG. 2 is a partially expanded diagram of the voltage waveform diagram shown in FIG. 1.

Reasons for the above are explained by referring to FIG. 2 and FIGS. 3A to 3D. FIG. 2 is an expanded diagram showing a waveform of the sustaining discharge erasing pulse 30*a* being applied during a period from a sustaining period to a subsequent initializing period. FIGS. 3A to 3D are diagrams schematically illustrating arrangements of wall charges made according to the method for driving a PDP of the first embodiment of the present invention.

Figure 3A:
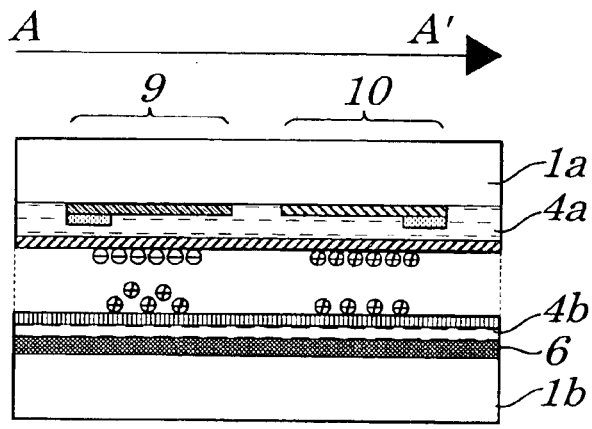
FIGS. 3A to 3D are diagrams for illustrating states of discharge and arrangements of wall charges appearing while a sustaining discharge erasing pulse is being applied in the method for driving a PDP according to the first embodiment of the present invention.
Figure 3B:
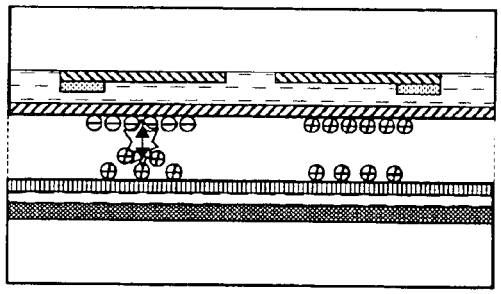

In the method for driving a PDP of the first embodiment of the present invention, at time of starting application of 5 cycles of the sustaining pulse 30*d* immediately before the sustaining period ends, a negative bias voltage of Vd2 is provided to the data electrode 6. As a result, immediately after the end of the sustaining discharge, a wall voltage being higher by an absolute value of a voltage Vd2 than a voltage having the driving waveform employed in the conventional method is applied between the scanning electrode 9 and the data electrode 6 (FIG. 3A).

As a result, start time of facing discharge (FIG. 3B) occurring between the scanning electrode 9 and the data electrode 6 by application of the sustaining discharge erasing pulse 30*a* is the time Tfm2 shown in FIG. 2 and, therefore, the facing discharge starts earlier than the time Tfm employed in the conventional method for driving the PDP 20.

When it is assumed that a voltage to be applied to the scanning electrode 9 at the time Tfsw is "V(Tfsw)" and a voltage to be applied to the scanning electrode 9 at the time Tfm is "V(Tfm)", by determining the V(Tfsw), V(Tfm), and |Vd2| so that a following expression holds, the start time Tfm2 of facing discharge between the scanning electrode 9 and the data electrode 6 comes earlier than the start time Tfsw of surface discharge between the scanning electrode 9 and the sustaining electrode 10:

$$V(Tfsw)-V(Tfm)<|Vd2|$$

Figure 23A:
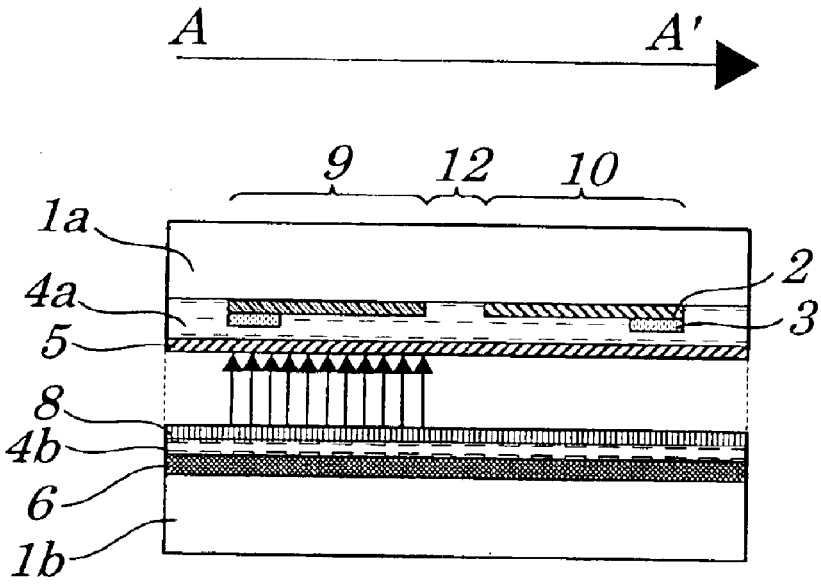
FIG. 23A is a cross-sectional view for explaining the method for driving the PDP (as shown in FIG. 15) according to a first embodiment of the present invention and for showing an electric field between a scanning electrode and a data electrode, taken in a line A–A' of a data electrode, the cross-sectional view in which lines of electric force between the electrodes are shown.
Figure 23B:
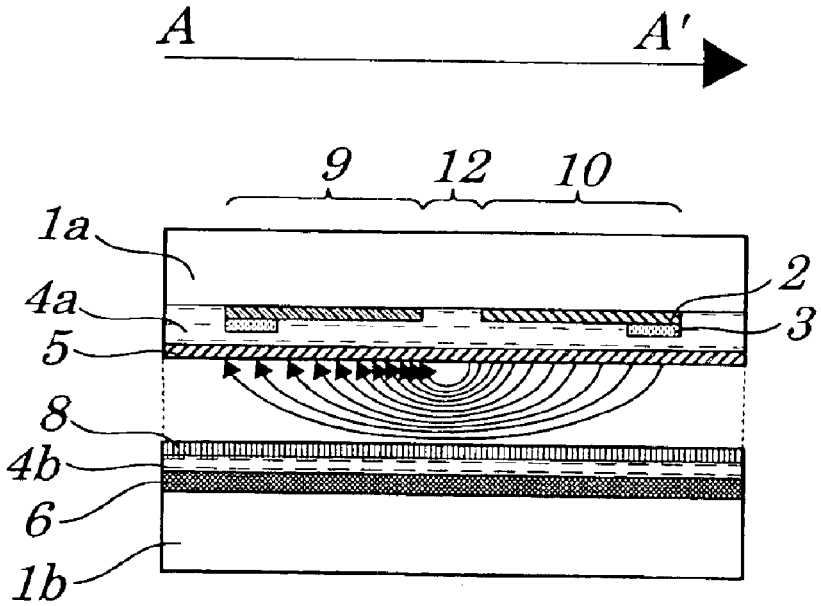
FIG. 23B is a cross-sectional view for explaining the conventional method for driving the PDP as shown in FIG. 15 and for showing an electric field between a scanning electrode and a sustaining electrode, taken in a line A–A' of a data electrode, the cross-sectional view in which lines of electric force between the electrodes are shown.

Though the scanning electrode 9 and sustaining electrode 10 are placed in the same plane, the scanning electrode 9 is placed so as to face the data electrode 6 in parallel and at the same interval with discharge space being interposed between the scanning electrode 9 and the data electrode 6 and areas of the scanning electrode 9 and the data electrode 6 facing each other are large and, therefore, an electric field produced between the scanning electrode 9 and the data electrode 6 become uniform as shown by lines of electric force in FIG. 23A.

Since areas of the scanning electrode 9 and the data electrode 6 facing each other are large and occurrence probability of discharge is high, time of occurrence of discharge is not delayed so much. Therefore, a potential difference exceeding a discharge initiating voltage between the scanning electrode 9 and the data electrode 6 is not fed easily, feeble discharge between the scanning electrode 9 and the data electrode 6 occurs in a more stable manner compared with the feeble discharge between the scanning electrode 9 and the sustaining electrode 10.

Figure 3C:
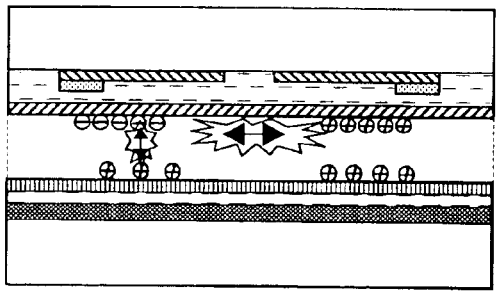

When facing discharge occurs between the scanning electrode 9 and the data electrode 6, since ions or metastables are produced within discharge space and the discharge space is put in an activated state in which discharge occurs readily and, therefore, surface discharge readily occurs between the scanning electrode 9 and the sustaining electrode 10. Therefore, in the conventional method for driving the PDP 20, when occurrence probability of surface discharge between the scanning electrode 9 and the sustaining electrode 10 is low, feeble discharge between the scanning electrode 9 and the sustaining electrode 10 does not occur easily, thus causing erroneous light emitting of a cell not selected to occur due to intense discharge. However, according to the method for driving a PDP of the embodiment of the present invention, since the discharge space has been in the activated state, feeble discharge occurs easily (FIG. 3C).

Figure 3D:
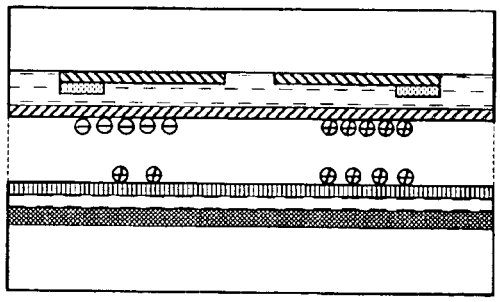

After the application of the sustaining discharge erasing pulse 30*a*, wall charges are arranged in a manner to facilitate smooth succeeding pre-discharge (FIG. 3D). That is, negative charges are accumulated on the dielectric layer 4*a* above the scanning electrode 9, positive charges on the dielectric layer 4*a* above the sustaining electrode 10, and on the other hand, positive charges on the dielectric layer 4*b* above the data electrode 6.

Therefore, since feeble discharge comes to occur in a stable manner by application of the sustaining discharge erasing pulse 30*a*, erroneous light emitting of a cell caused by intense discharge can be prevented.

In the embodiment, in order for the occurrence time Tfm of discharge between the scanning electrode 9 and the data electrode 6 to come earlier than the occurrence time Tfsw of feeble discharge between the scanning electrode 9 and the sustaining electrode 10, the negative voltage Vd2 to be applied to the data electrode 6 is set so that a following expression is satisfied:

$$V(Tfsw)-V(Tfm)<|Vd2|$$

However, since an aim is achieved if intense discharge between the scanning electrode 9 and the sustaining electrode 10 can be inhibited, the negative voltage Vd2 to be applied to the data electrode 6 can be also set so that a following expression is satisfied:

$$V(Tfss)-V(Tfm)<|Vd2|$$

where V(Tfss) denotes a voltage to be applied to the scanning electrode 9 at time Tfss.

That is, when a voltage obtained by subtracting a voltage applied to the scanning electrode 9 at the time Tfm when facing discharge occurs by the conventional method for driving the PDP 20 from a voltage applied to the scanning electrode 9 at the time Tfss being the earliest time at which intense discharge occurs is smaller than the voltage Vd2 being the negative bias voltage to be applied to the data electrode 6, occurrence of intense discharge induced by the application of the sustaining discharge erasing pulse 30*a* can be prevented.

Only if the pulse Vd2 having a negative polarity to be applied to the data electrode 6 has been applied at last time of discharge occurring during the sustaining period, effects of wall charge accumulation on the dielectric layer 4*b* above the data electrode 6 can be obtained, however, in some cases, charges cannot be accumulated smoothly only by the last discharge during the sustaining period.

When the number of times of sustaining discharge while the pulse Vd2 having a negative polarity to be applied to the data electrode 6 is being applied is increased, more stable effects can be easily achieved. Therefore, in the method for driving a PDP of the first embodiment of the present invention, at time of starting the application of 5 cycles of the sustaining pulse 30*d* immediately before the sustaining period terminates, the pulse Vd2 having a negative polarity is provided to the data electrode 6.

Moreover, the pulse Vd2 having a negative polarity may be provided at time of starting application of 6 cycles or more of the sustaining pulse 30*d* before the sustaining period terminates.

Figure 4:
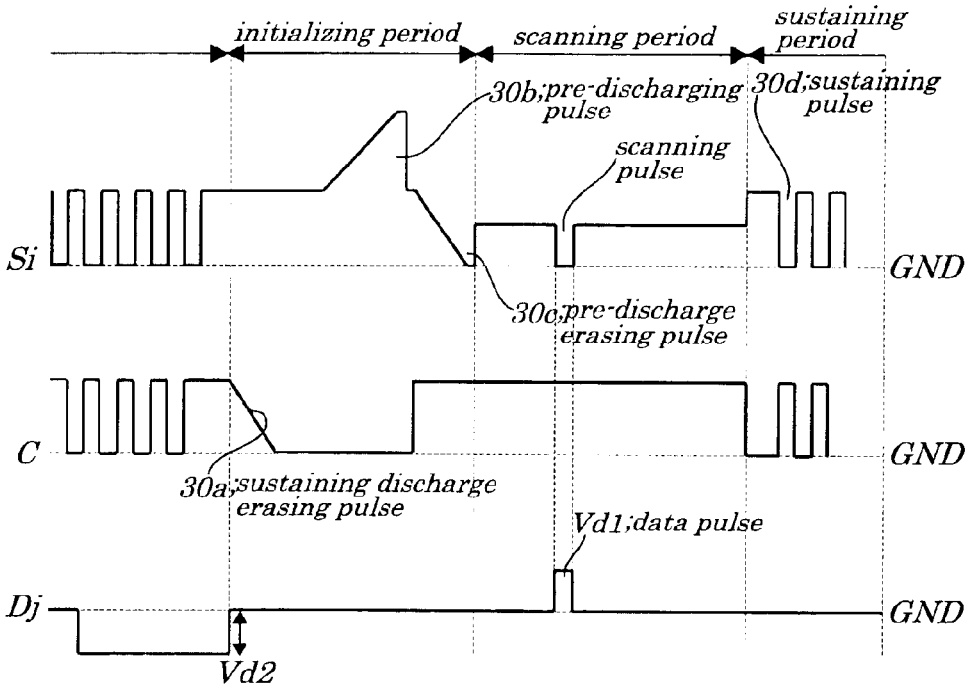
FIG. 4 is a voltage waveform diagram showing waveforms of voltages to be applied to each electrode according to a modified example of the method for driving a PDP of the first embodiment of the present invention.

FIG. 4 is a voltage waveform diagram showing waveforms of voltages to be applied to each electrode according to a modified example of the method for driving a PDP of the first embodiment of the present invention.

In the first embodiment, the sustaining discharge erasing pulse 30*a* is applied to the scanning electrode 9, however, in the modified example, as shown in FIG. 4, the sustaining discharge erasing pulse 30*a* is applied to the sustaining electrode 10.

In the modified example, by providing a negative bias voltage of Vd2 to the data electrode 6 at time of starting the application of 5 cycles of the sustaining pulse 30*d* immediately before the sustaining period terminates, the same effects obtained in the above first embodiment can be achieved.

Figure 5:
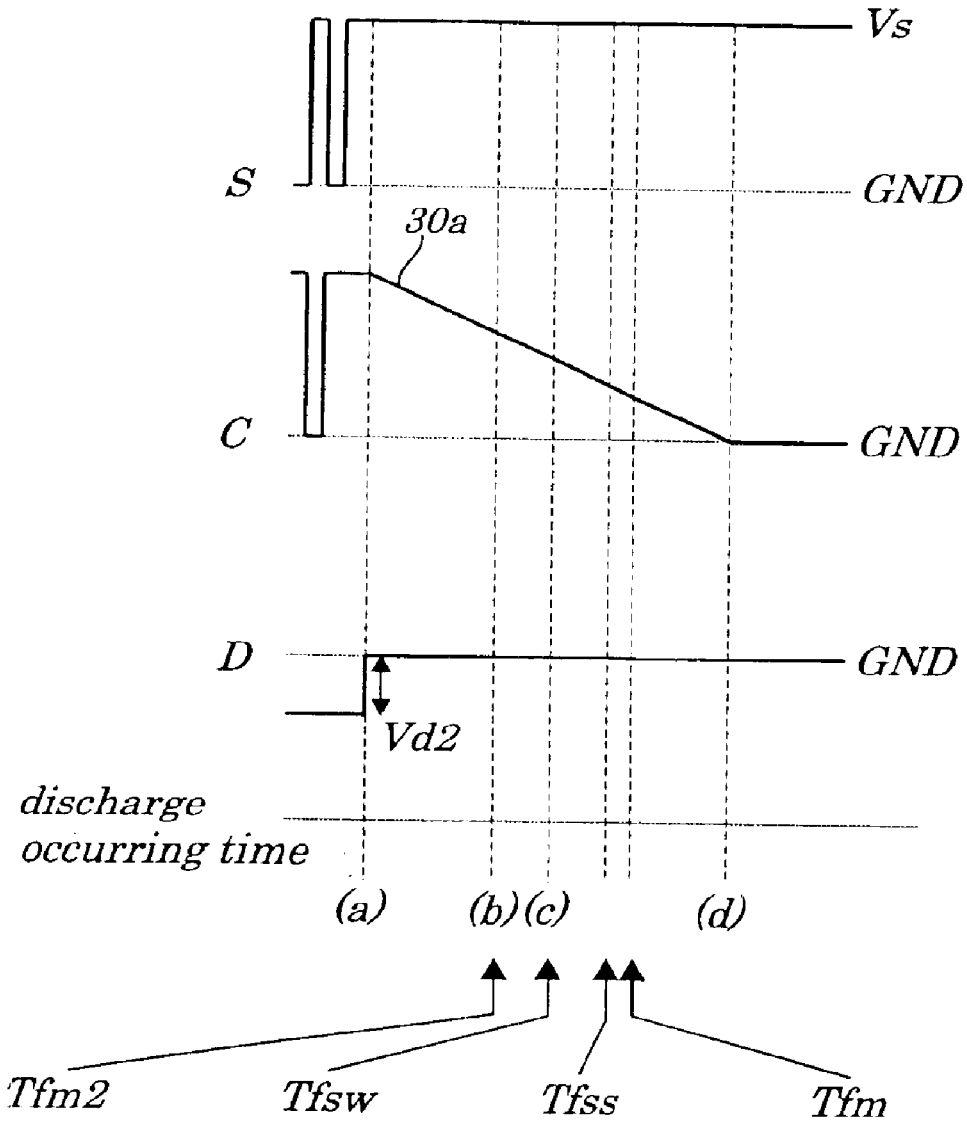
FIG. 5 is a partially expanded diagram of the voltage waveform diagram of FIG. 4.

FIG. 5 is an expanded waveform diagram of the sustaining discharge erasing pulse 30*a* to be applied during a period from the sustaining period to a subsequent initializing period.

In the first embodiment, as shown in FIG. 2, start time of the discharge between the scanning electrode 9 and data electrode 6 to which a voltage having the inclined waveform is being applied is Tfm2, while, in the modified example, as shown in FIG. 5, start time of the discharge between the sustaining electrode 10 and the data electrode 6 to which a voltage having the inclined waveform is being applied is Tfm2.

Since the discharge start time Tfm2 comes earlier than the start time Tfsw of discharge between the sustaining electrode 10 and the scanning electrode 9, feeble discharge occurs in a stable manner by application of the sustaining discharge erasing pulse 30*a*. Therefore, also in the modified example, erroneous light emitting of a cell caused by intense discharge can be prevented.

Second Embodiment

Figure 6:
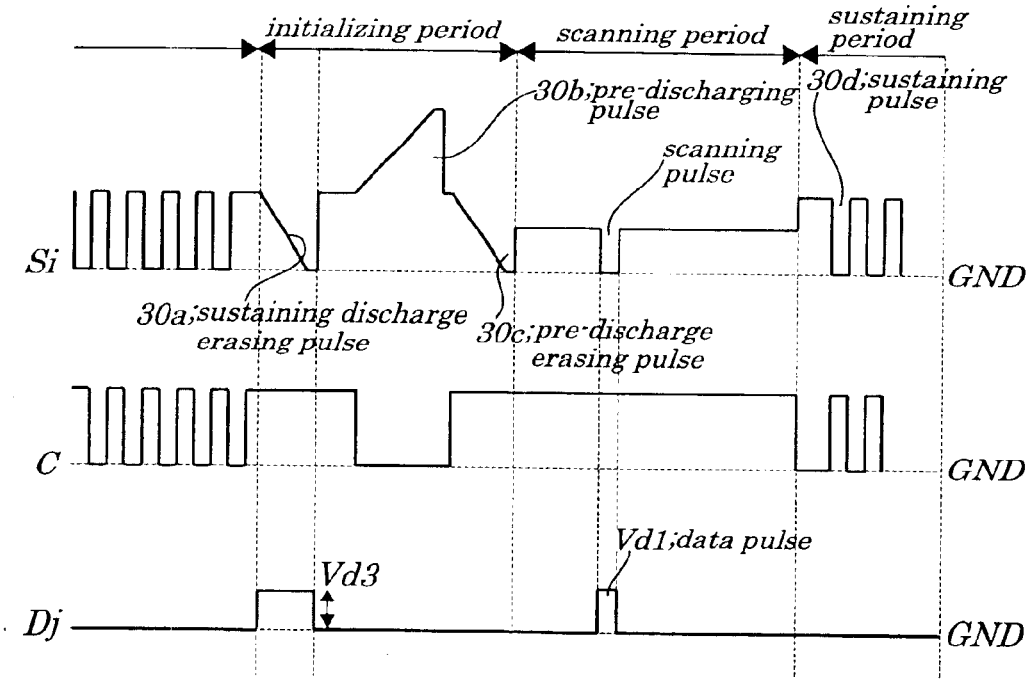
FIG. 6 is a voltage waveform diagram showing waveforms of voltages to be applied to each electrode according to a method for driving a PDP of a second embodiment of the present invention.
Figure 7:
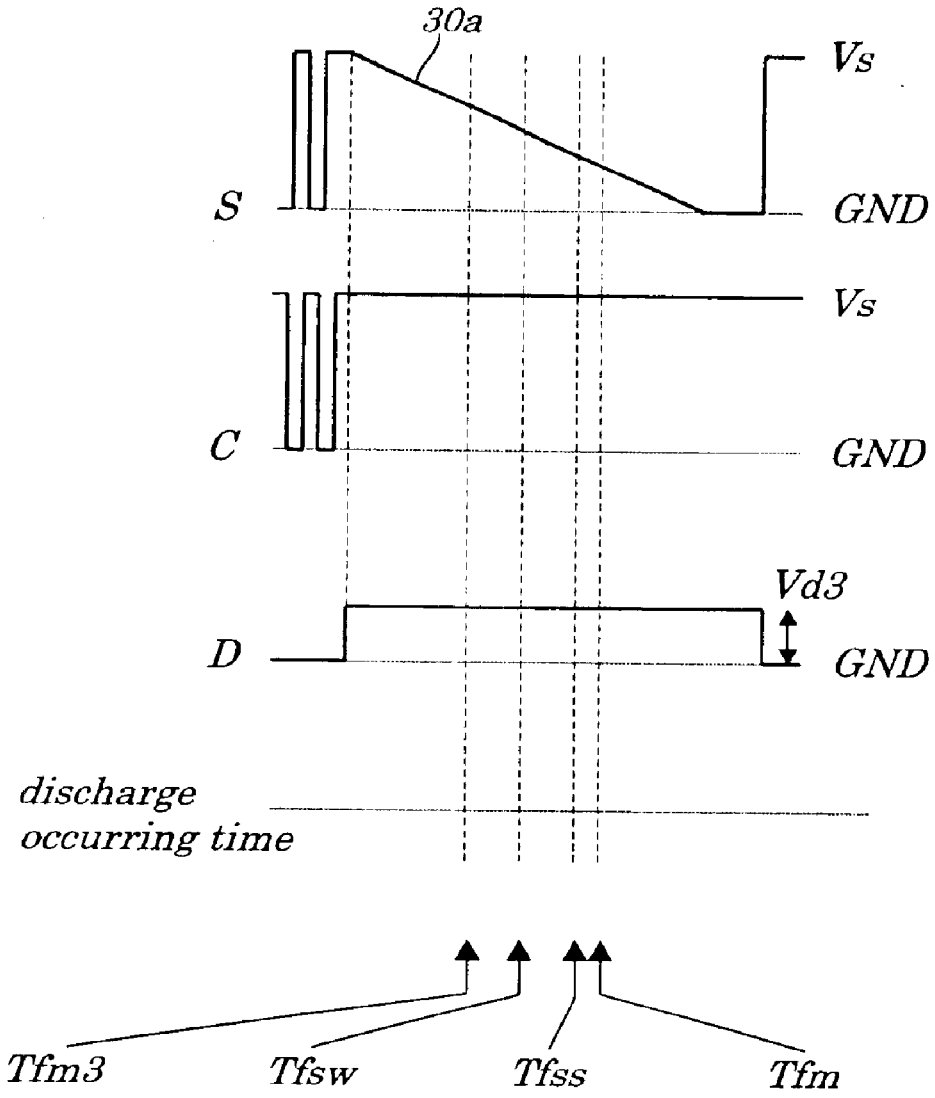
FIG. 7 is a partially expanded diagram of the voltage waveform diagram of FIG. 6.

A method for driving a PDP of a second embodiment of the present invention is described by referring to FIG. 6 and FIG. 7.

A PDP used in the second embodiment has the same configurations as the PDP 20 employed in the conventional method shown in FIG. 15.

FIG. 6 is a voltage waveform diagram showing waveforms of voltages to be applied to each electrode according to the method for driving a PDP of the second embodiment of the present invention. In FIG. 6, a mark "Si" shows a waveform of a voltage to be applied to a scanning electrode 9 to be scanned by the i-th scanning operation, a mark "C" shows a waveform of a voltage to be applied to a sustaining electrode 10, and a mark "Dj" shows a waveform of a voltage to be applied to a data electrode 6 placed in the j-th order.

As shown in FIG. 6, one period for basic driving a PDP includes an initializing period during which a state of a cell is initialized and the PDP is put in readiness for occurrence of discharge, a scanning period during which a cell to be used for display is selected, and a sustaining period during which the cell selected during the scanning period is made to be emitted.

The initializing period and the scanning period are the same as those employed in the conventional method for driving the PDP 20.

The method for driving a PDP of the second embodiment differs from that in the first embodiment only in that the sustaining discharge erasing pulse 30*a* has a different waveform.

FIG. 7 shows an expanded waveform diagram of the sustaining discharge erasing pulse 30*a* to be applied during a period from the sustaining period to a subsequent initializing period in the method for driving a PDP of the second embodiment.

In the second embodiment, a pulse Vd3 having a positive polarity is applied to the data electrode 6 while the sustaining discharge erasing pulse 30*a* having an inclined waveform is being applied. Thus, by applying the pulse Vd3 having a positive polarity to the data electrode 6, occurrence of intense discharge that occurs accidentally during the application of the sustaining discharge erasing pulse 30*a* can be inhibited.

As in the case of the conventional method for driving the PDP 20, after termination of the sustaining period, immediately before application of the sustaining discharge erasing pulse 30*a*, negative charges have been accumulated on the dielectric layer 4*a* above the scanning electrode 9, positive charges on the dielectric layer 4*a* above the sustaining electrode 10, and positive charges on the dielectric layer 4*b* above the data electrode 6.

While the sustaining discharge erasing pulse 30*a* is being applied, since the pulse Vd3 having a positive polarity is applied to the data electrode 6, a voltage to be applied between the scanning electrode 9 and the data electrode 6 is higher by the pulse voltage Vd3 than the voltage applied in the conventional method for driving the PDP 20.

As a result, start time of discharge between the scanning electrode 9 and the data electrode 6 is Tfm3 which causes the discharge between the electrode 9 and the data electrode 6 to start earlier than the start time Tfm in the conventional method for driving the PDP 20.

When it is assumed that a voltage to be applied to the scanning electrode 9 at the time Tfsw is "V(Tfsw)" and a voltage to be applied to the data electrode 6 at the time Tfm is "V(Tfm)", by determining the V(Tfsw), V(Tfm), and Vd3 so that a following expression holds, the start time Tfm3 of discharge between the scanning electrode 9 and the data electrode 6 becomes earlier than the start time Tfsw of discharge between the scanning electrode 9 and the sustaining electrode 10:

$$V(Tfsw)-V(Tfm)<Vd3$$

When discharge between the scanning electrode 9 and the data electrode 6 occurs earlier than discharge between the scanning electrode 9 and the sustaining electrode 10, discharge space is put into an activated state, which enables discharge between the scanning electrode 9 and the sustaining electrode 10 to occur in a stable manner. As a result, occurrence of intense discharge that occurs accidentally can be inhibited.

Third Embodiment

Figure 8:
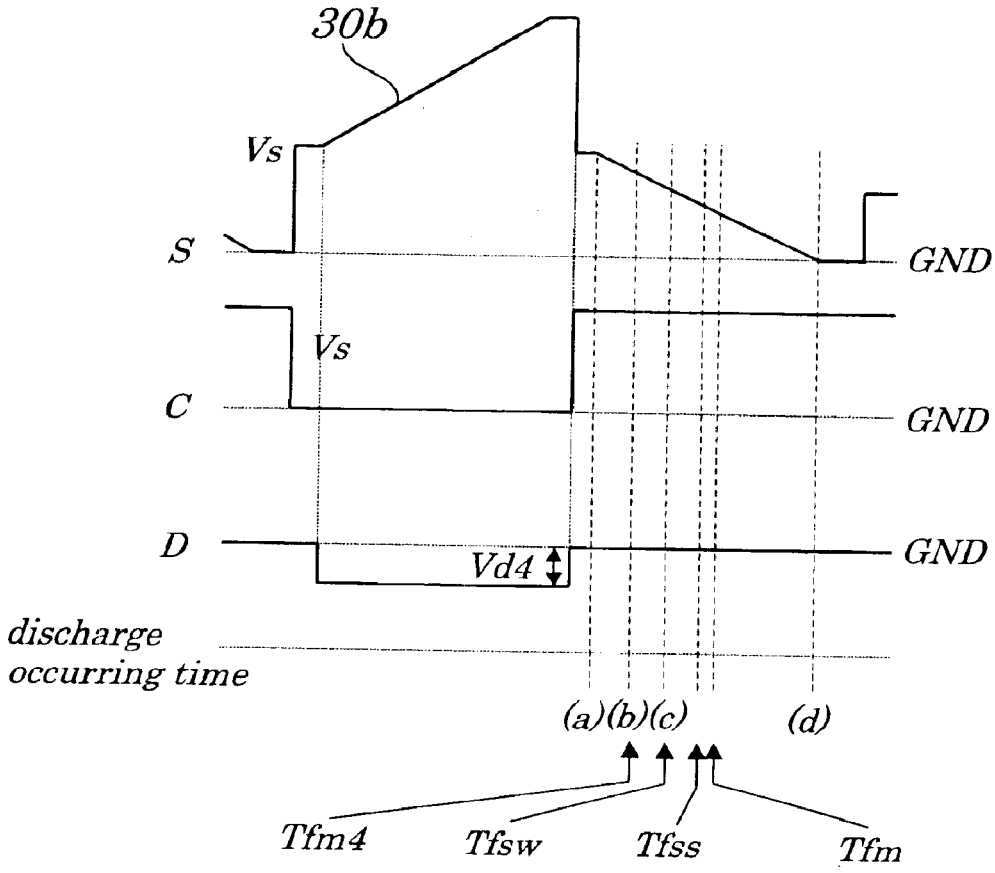
FIG. 8 is a voltage waveform diagram showing waveforms of voltages to be applied to each electrode according to a method for driving a PDP of a third embodiment of the present invention.

A method for driving a PDP of a third embodiment of the present invention is described by referring to FIG. 8.

A PDP used in the third embodiment has the same configurations as the PDP 20 employed in the conventional method shown in FIG. 15.

FIG. 8 shows waveforms of voltages to be applied to each electrode in the method for driving a PDP of the third embodiment and is especially an expanded diagram of the sustaining discharge erasing pulse 30*a* to be applied during a period from the sustaining period to a subsequent initializing period.

In FIG. 8, a mark "Si" shows a waveform of a voltage to be applied to a scanning electrode 9 to be scanned by the i-th scanning operation, a mark "C" shows a waveform of a voltage to be applied to a sustaining electrode 10, and a mark "Dj" shows a waveform of a voltage to be applied to a data electrode 6 placed in the j-th order.

In the method for driving a PDP of the third embodiment, the sustaining discharge erasing pulse 30*a* and the pre-discharge erasing pulse 30*c* to be applied during the initializing period have the same waveforms as those in the conventional method for driving the PDP 20. The scanning period and sustaining period following the initializing period are also the same as those in the conventional method for driving the PDP 20.

The method for driving a PDP of the third embodiment differs from that in the conventional method for driving the PDP 20 only in that the pre-discharging pulse 30*b* has a different waveform.

In the method for driving a PDP of the third embodiment, a waveform of a driving voltage to be applied to the scanning electrode 9 and the sustaining electrode 10 at time of application of the pre-discharging pulse 30*b* is the same as that of a driving voltage to be applied in the conventional method for driving the PDP 20, however, unlike in the case of the conventional method, a pulse voltage Vd4 having a negative polarity is applied to the data electrode 6.

Thus, by applying the pulse voltage Vd4 having a negative polarity to the data electrode 6, occurrence of intense discharge that occurs accidentally while the pre-discharge erasing pulse 30*c* is being applied can be inhibited.

Reasons for the above are explained by referring to FIG. 8 and FIGS. 9A to 9D. FIGS. 9A to 9D is a diagram schematically illustrating arrangements of wall charges made in the method for driving a PDP of the third embodiment.

Figure 9A:
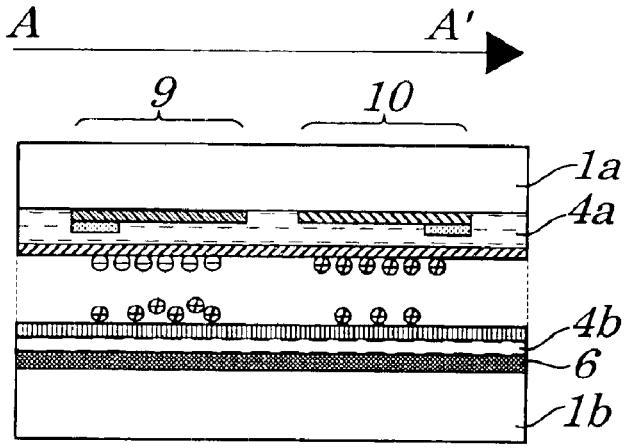
FIGS. 9A to 9D are diagrams illustrating states of discharge and arrangements of wall charges appearing while a pre-discharge erasing pulse is being applied in the method for driving a PDP according to the third embodiment of the present invention.

While the pre-discharging pulse 30*b* is being applied, by providing a negative bias voltage being equivalent to the pulse voltage vd4 to the data electrode 6, immediately after termination of the pre-discharge, a wall voltage being higher by an absolute value of the pulse voltage Vd4 than that to be obtained by the conventional method is applied to the dielectric layer 4*b* above the data electrode 6 facing the scanning electrode 9 (FIG. 9A)

Figure 9B:
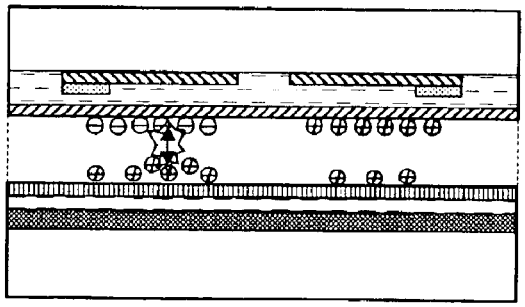

As a result, start time of discharge between the scanning electrode 9 and the data electrode 6 by application of the pre-discharge erasing pulse 30*c* is Tfm4 shown in FIG. 8 and facing discharge between the scanning electrode 9 and the data electrode 6 starts earlier than the time Tfm used in the conventional method for driving the PDP 20 (FIG. 9B).

When it is assumed that a voltage to be applied to the scanning electrode 9 at the time Tfsw is "V(Tfsw)" and a voltage to be applied to the data electrode 6 at the time Tfm is "V(Tfm)", by determining the V(Tfsw), V(Tfm), and |Vd4| so that a following expression holds, the start time Tfm4 of facing discharge between the scanning electrode 9 and the data electrode 6 becomes earlier than the start time Tfsw of facing discharge between the scanning electrode 9 and the sustaining electrode 10:

$$V(Tfsw)-V(Tfm)<|Vd4|$$

Since an electric field generated between the scanning electrode 9 and the data electrode 6 is uniform, feeble discharge occurs in a stable manner.

Figure 9C:
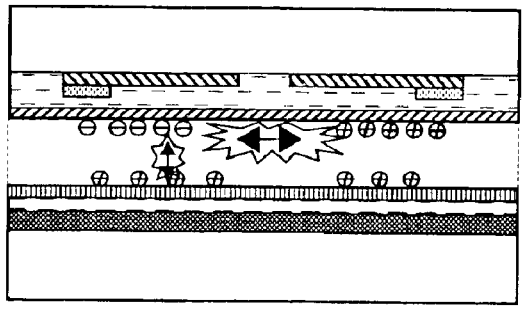

When facing discharge occurs between the scanning electrode 9 and the data electrode 6, ions and/or metastables are produced in discharge space which is then put into an active state where discharge occurs readily, which further causes surface discharge between the scanning electrode 9 and the sustaining electrode 10 to occur readily. Therefore, even when feeble discharge does not occur by the conventional method for driving the PDP 20, according to the method for driving a PDP of the third embodiment, since the discharge space is put in an activated state, feeble discharge easily occurs between the scanning electrode 9 and the sustaining electrode 10 (FIG. 9C).

Figure 9D:
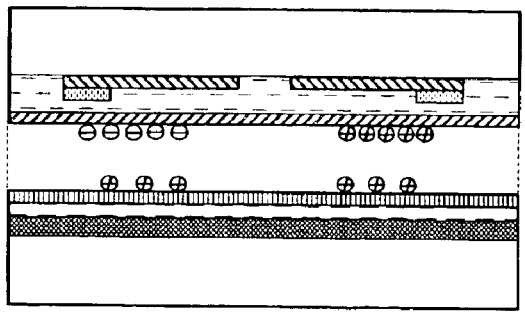

After application of the pre-discharge erasing pulse 30*c*, charges are arranged in a manner that operations during a succeeding scanning period are smooth (FIG. 9D). That is, negative charges are accumulated on the dielectric layer 4*a* above the scanning electrode 9 and positive charges on the dielectric layer 4*a* above the sustaining electrode 10. On the other hand, positive charges are accumulated on the dielectric layer 4*b* above the data electrode 6.

This causes feeble discharge to occur in a stable manner by application of the pre-discharge erasing pulse 30*c*, thus preventing erroneous light emitting of a cell caused by intense discharge.

Fourth Embodiment

Figure 10:
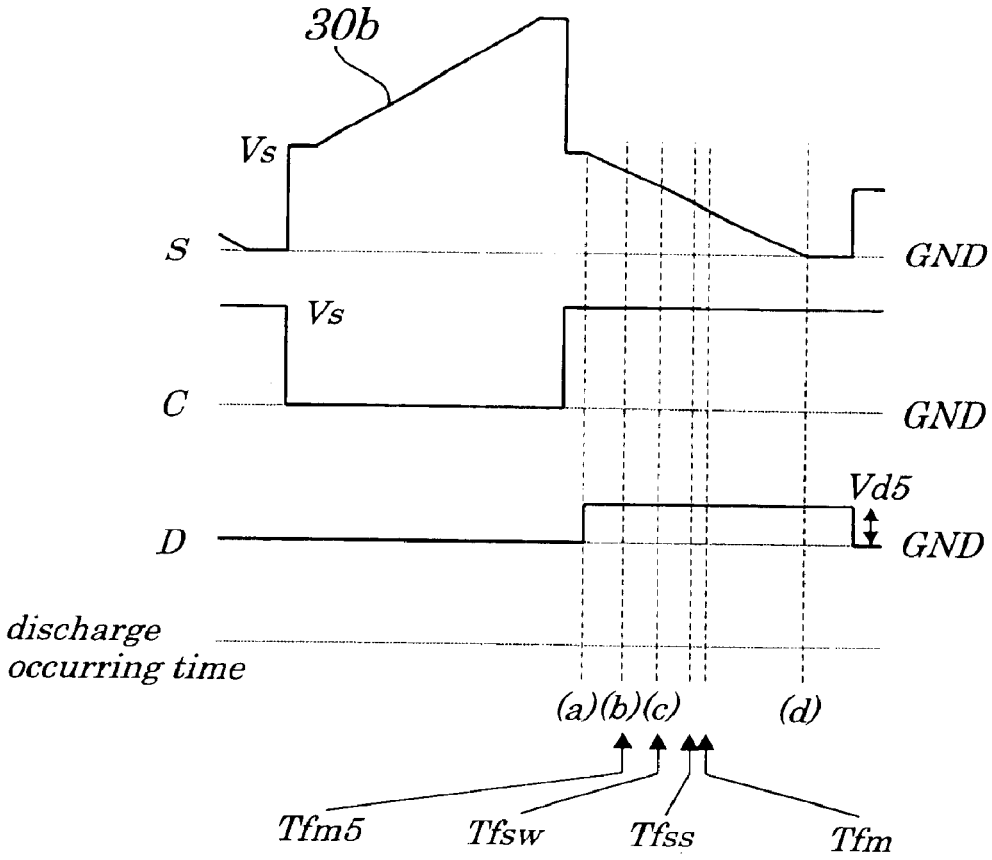
FIG. 10 is a voltage waveform diagram showing waveforms of voltages to be applied to each electrode according to a method for driving a PDP of a fourth embodiment of the present invention.

A method for driving a PDP of a fourth embodiment of the present invention is described by referring to FIG. 10.

A PDP used in the fourth embodiment has the same configurations as the PDP 20 employed in the conventional method shown in FIG. 15.

FIG. 10 shows waveforms of voltages to be applied to each electrode in the method for driving a PDP of the fourth embodiment and is especially an expanded diagram of the pre-discharge erasing pulse 30*c* to be applied during a period from the sustaining period to a subsequent initializing period.

In FIG. 10, a mark "Si" shows a waveform of a voltage to be applied to a scanning electrode 9 to be scanned by the i-th scanning operation, a mark "C" shows a waveform of a voltage to be applied to a sustaining electrode 10, and a mark "Dj" shows a waveform of a voltage to be applied to a data electrode 6 placed in the j-th order.

In the method for driving a PDP of the fourth embodiment, the sustaining discharge erasing pulse 30*a* and the pre-discharging pulse 30*b* to be applied during the initializing period have the same waveforms as those in the conventional method for driving the PDP 20. Scanning period and sustaining period following the initializing period are also the same as those in the conventional method for driving the PDP 20. The method for driving a PDP of the fourth embodiment differs from that in the conventional method for driving the PDP 20 only in that the pre-discharging pulse 30*c* has a different waveform.

In the method for driving a PDP of the fourth embodiment, a waveform of a driving voltage to be applied to the scanning electrode 9 and the sustaining electrode 10 at time of application of the pre-discharging pulse 30*c* is the same as that of a driving voltage to be applied in the conventional method for driving the PDP 20, however, unlike in the case of the conventional method, a pulse voltage Vd5 having a positive polarity is applied to the data electrode 6.

Thus, by applying the pulse voltage Vd5 having a positive polarity to the data electrode 6, occurrence of intense discharge that occurs accidentally while the pre-discharge erasing pulse 30*c* is being applied can be inhibited.

Reasons for the above are explained by referring to FIG. 10 and FIGS. 11A to 11D. FIGS. 11A to 11D are diagrams for schematically illustrating arrangements of wall charges appearing in the method for driving a PDP of the fourth embodiment.

Figure 11A:
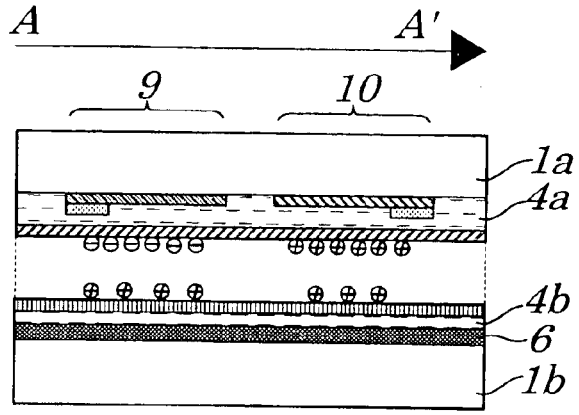
FIGS. 11A to 11D are diagrams for illustrating states of discharge and arrangements of wall charges appearing while a pre-discharge erasing pulse is being applied in the method for driving a PDP according to the fourth embodiment of the present invention.
Figure 11B:
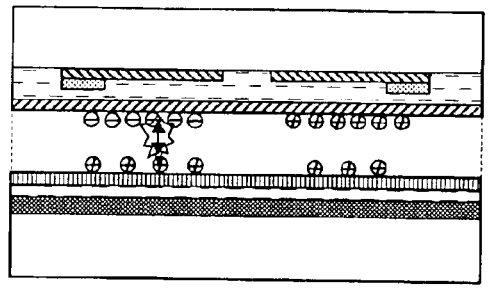

FIG. 11A shows arrangements of wall charges appearing immediately after start of application of the pre-discharge erasing pulse 30*c*.

As in the case of the second embodiment where the pulse voltage Vd3 having a positive polarity is applied to the data electrode 6 while the sustaining discharge erasing pulse 30*a* is applied, in the fourth embodiment, a pulse voltage Vd5 having a positive polarity is applied to the data electrode 6 while the pre-discharge erasing pulse 30*c* is applied.

Thus, by applying the pulse voltage Vd5 having a positive polarity to the data electrode 6, occurrence of intense discharge that occurs accidentally while the pre-discharge erasing pulse 30*c* is being applied can be inhibited.

Immediately before the application of the pre-discharge erasing pulse 30*c*, negative charges have been accumulated on the surface of the dielectric layer 4*a* on the scanning electrode 9 and positive charges on the surface of the dielectric layer 4*a* on the sustaining electrode 10, and positive charges on the surface of the dielectric layer 4*b* on the data electrode 6.

While the pre-discharge erasing pulse 30*c* is being applied, the pulse voltage Vd5 having a positive polarity is applied to the data electrode 6 and a voltage to be applied between the scanning electrode 9 and the data electrode 6 is higher by the pulse voltage Vd5 than the voltage applied by the conventional method for driving the PDP 20.

As a result, start time of discharge between the scanning electrode 9 and the data electrode 6 is Tfm5 and the discharge between the scanning electrode 9 and the data electrode 6 starts earlier than the time Tfm used in the conventional method for driving the PDP 20.

When it is assumed that a voltage to be applied to the scanning electrode 9 at the time Tfsw is "V(Tfsw)" and a voltage to be applied to the data electrode 6 at the time Tfm is "V(Tfm)", by determining the V(Tfsw), V(Tfm), and Vd5 so that a following expression holds, the start time Tfm5 of discharge between the scanning electrode 9 and the data electrode 6 becomes earlier than the start time Tfsw of surface discharge between the scanning electrode 9 and the sustaining electrode 10 (FIG. 11B):

$$V(Tfsw)-V(Tfm)<Vd5.$$

Figure 11C:
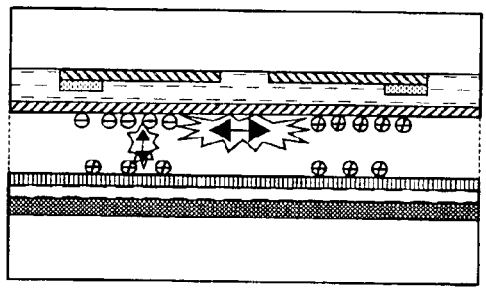

By occurrence of the facing discharge between the scanning electrode 9 and the data electrode 6, discharge space is put into an active state and, as a result, surface discharge between the scanning electrode 9 and the sustaining electrode 10 comes to occur in a stable manner (FIG. 11C).

Figure 11D:
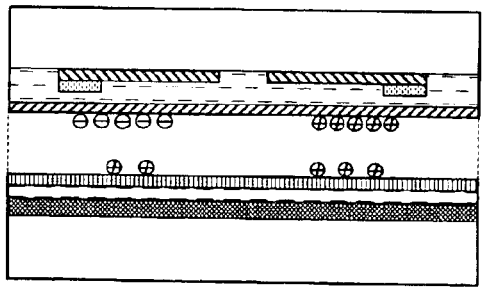

That is, according to the fourth embodiment, it is possible to prevent intense discharge that occurs accidentally in the conventional method. As a result, after application of the pre-discharge erasing pulse 30*c*, charges are arranged in a manner that operations during a succeeding scanning period are smooth (FIG. 11D). That is, negative charges are accumulated on the dielectric layer 4*a* above the scanning electrode 9 and positive charges on the dielectric layer 4*a* above the sustaining electrode 10. On the other hand, positive charges are accumulated on the dielectric layer 4*b* above the data electrode 6.

Figure 12:
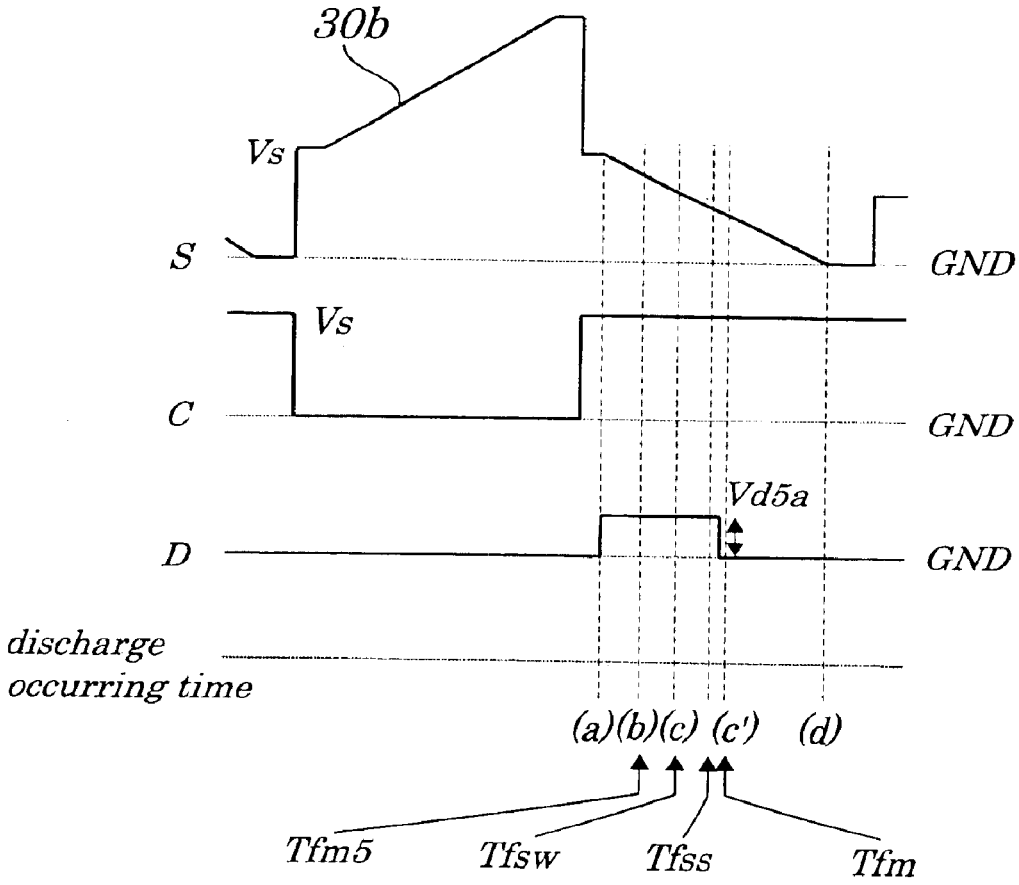
FIG. 12 is a voltage waveform diagram showing waveforms of voltages to be applied to each electrode according to a modified example of the method for driving a PDP of the fourth embodiment of the present invention.

FIG. 12 is a voltage waveform diagram showing waveforms of voltages to be applied to each electrode according to a modified example of the method for driving a PDP of the fourth embodiment and is especially an expanded diagram of the pre-discharge erasing pulse 30*c* to be applied during a period from the sustaining period to a subsequent initializing period.

The modified example of the method for driving a PDP of the fourth embodiment is described by referring to FIG. 12.

In the fourth embodiment, during all periods while the pre-discharge erasing pulse 30*c* is being applied, the pulse voltage Vd5 having a positive polarity continues to be applied to the data electrode 6. As a result, facing discharge between the scanning electrode 9 and the data electrode 6 continues from start of the discharge to end of the application of a voltage having an inclined waveform.

However, since this causes great decrease in positive charges accumulated on the dielectric layer 4*b* above the data electrode 6, even if a cell has to be selected during a succeeding writing period, a sum of an externally applied voltage and a wall voltage cannot exceed a discharge initiating voltage, thus producing a fear that the writing discharge does not occur. In this case, to cause the writing discharge to surely occur, a voltage of a data pulse to be applied during the scanning period has to be higher than that employed in the conventional method for driving the PDP 20.

To solve this problem, according to the modified example, as shown in FIG. 12, instead of continuous application of the pulse voltage Vd5 having a positive polarity to the data electrode 6 for all periods during which the pre-discharge erasing pulse 30*c* is being applied, after a pulse voltage Vd5*a* having a positive polarity has been applied continuously to the data electrode 6 until the time Tfsw being the time of start of surface discharge between the scanning electrode 9 and the sustaining electrode 10, the application of the pulse is then made to end.

FIGS. 13A to 13D are diagrams schematically illustrating arrangements of wall charges made in the modified example.

Figure 13A:
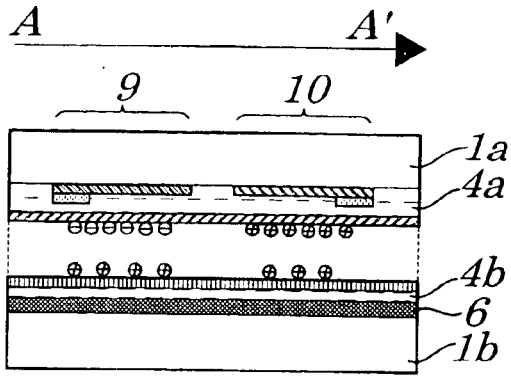
FIGS. 13A to 13D are diagrams for illustrating states of discharge and arrangements of wall charges appearing while a pre-discharge erasing pulse is being applied in the modified example of the fourth embodiment of the present invention.

FIG. 13A shows arrangement of wall charges appearing immediately after start of application of the pre-discharge erasing pulse 30*c*.

Figure 13B:
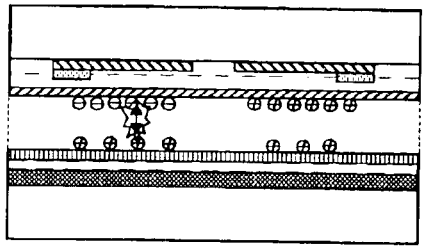

By applying the pulse voltage Vd5*a* having a positive polarity to the data electrode 6, prior to surface discharge between the scanning electrode 9 and the sustaining electrode 10, feeble facing discharge between the scanning electrode 9 and the data electrode 6 occurs (FIG. 13B).

Figure 13C:
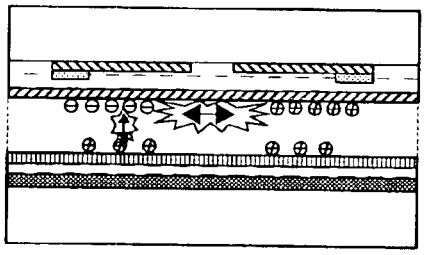
Figure 13C:
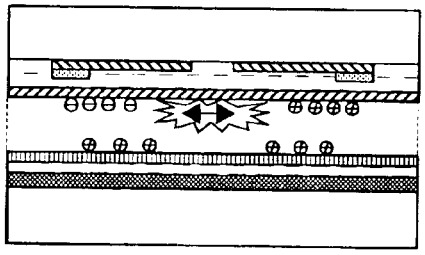

This discharge activates discharge space and, as a result, feeble discharge occurs also between the scanning electrode 9 and the sustaining electrode 10 (FIG. 13C).

Once feeble discharge has occurred, since the discharge itself activates discharge space and causes discharge to continue thereafter, even if the application of the pulse voltage Vd5*a* to the data electrode 6 is made to end, feeble surface discharge between the scanning electrode 9 and the sustaining electrode 10 occurs in a stable manner thereafter (FIG. 13C').

Figure 13D:
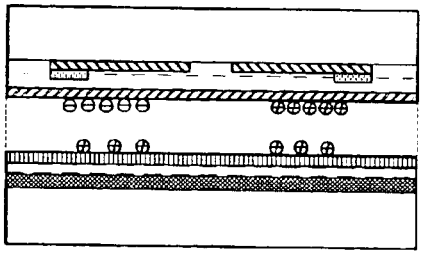

This makes it possible to prevent intense discharge that occurs accidentally in the conventional method. As a result, after the application of the pre-discharge erasing pulse 30*c*, charges are arranged in a manner that operations during a succeeding scanning period are smooth (FIG. 13D). That is, negative charges are accumulated on the dielectric layer 4*a* above the scanning electrode 9 and positive charges are accumulated on the dielectric layer 4*a* above the sustaining electrode 10. On the other hand, positive charges are accumulated on the dielectric layer 4*b* above the data electrode 6.

Since a level of the pulse voltage Vd5*a* being applied to the data electrode 6 is lowered up to a ground level midway, during the period thereafter, positive charges accumulated on the dielectric layer 4*b* on the data electrode 6 facing the scanning electrode 9 are not erased excessively. Therefore, during the writing period in a subsequent sub-field, it is not necessary that the pulse voltage Vd1 (see FIG. 1) to be applied to the data electrode 6 is made higher than that employed in the conventional method and the pulse voltage Vd1 and the pulse voltage Vd5 may have the same value.

As a result, since the pulse voltage Vd5*a* being applied while the pre-discharge erasing pulse 30*c* is applied and the pulse voltage Vd1 to be applied to the data electrode 6 during the scanning period may have the same value, the method of the above modified example has a merit in that the same driving circuit as employed in the conventional method can be also used without any change.

Fifth Embodiment

Figure 14:
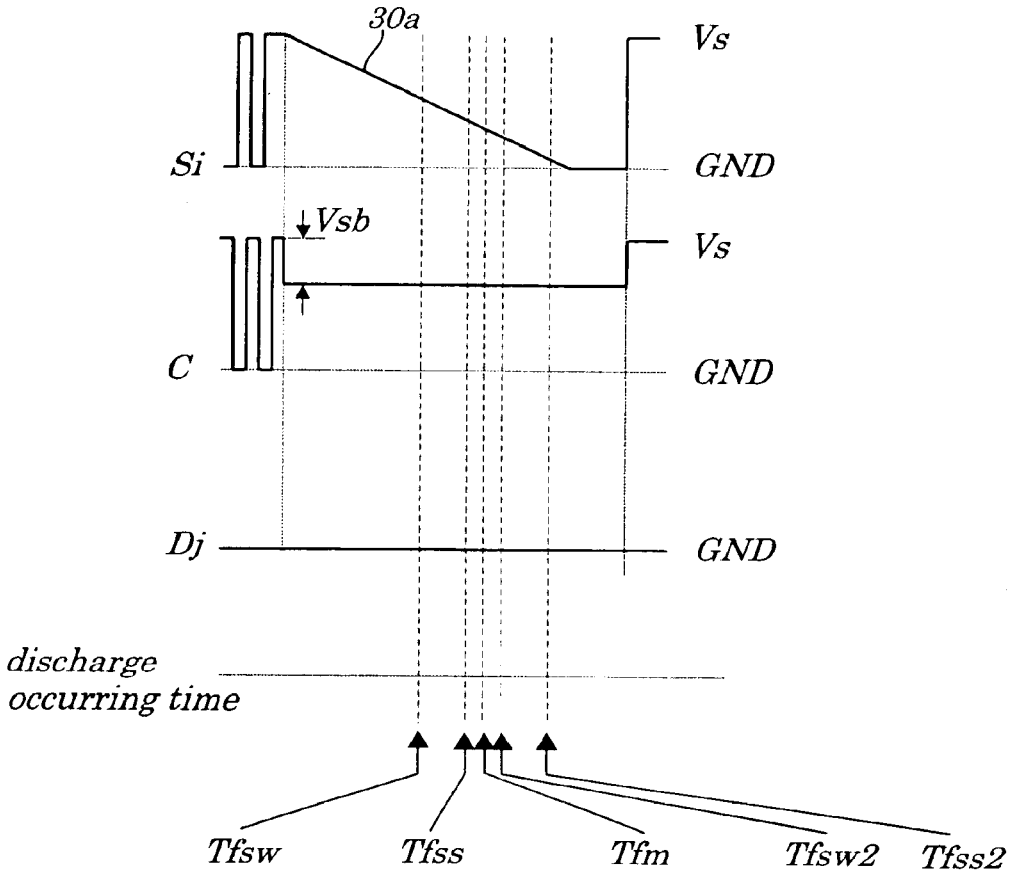
FIG. 14 is a voltage waveform diagram partially showing waveforms of a voltage to be applied to each electrode according to a method for driving a PDP of a fifth embodiment of the present invention.

A method for driving a PDP of a fifth embodiment of the present invention is described by referring to FIG. 14.

A PDP used in the fifth embodiment has the same configurations as the PDP 20 employed in the conventional method shown in FIG. 15.

FIG. 14 shows waveforms of voltages to be applied to each electrode in the method for driving the PDP of the fifth embodiment and is especially an expanded diagram of the sustaining discharge erasing pulse 30*a* to be applied during a period from the sustaining period to a subsequent initializing period.

In FIG. 14, a mark "Si" shows a waveform of a voltage to be applied to a scanning electrode 9 to be scanned by the i-th scanning operation, a mark "C" shows a waveform of a voltage to be applied to a sustaining electrode 10, and a mark "Dj" shows a waveform of a voltage to be applied to a data electrode 6 placed in the j-th order.

In the method for driving a PDP of the fifth embodiment, the pre-discharge erasing pulse 30*c* and the pre-discharge erasing pulse 30*c* to be applied during the initializing period have the same waveforms as those in the conventional method for driving the PDP 20. Scanning period and sustaining period following the initializing period are also the same as those in the conventional method for driving the PDP 20. The method for driving a PDP of the fifth embodiment differs from that in the conventional method for driving the PDP 20 in that the sustaining discharge erasing pulse 30*a* only has a different waveform.

In the method for driving a PDP of the fifth embodiment, a waveform of a driving voltage to be applied to the scanning electrode 9 and the data electrode 6 at time of application of the sustaining discharge erasing pulse 30*a* is the same as that of a driving voltage to be applied in the conventional method for driving the PDP 20. The method for driving a PDP of the fifth embodiment differs from that in the conventional method in that a voltage applied to the sustaining electrode 10 only has a different waveform.

That is, in the conventional method for driving the PDP 20, a voltage to be applied to the sustaining electrode 10 is held at a voltage level of "Vs". However, in the fifth embodiment, a voltage to be applied to the sustaining electrode 10 is held at a voltage being lower by a voltage "Vsb" than the voltage Vs, that is, at a voltage of "Vs−Vsb".

Thus, by holding a voltage to be applied to the sustaining electrode 10 at the voltage (Vs−Vsb), occurrence of intense discharge that occurs accidentally while the pre-discharge erasing pulse 30*c* is being applied can be inhibited.

As described above, by lowering a potential of the sustaining electrode 10 while the sustaining discharge erasing pulse 30*a* is being applied, a potential difference between the scanning electrode 9 and the sustaining electrode 10 is made smaller than that in the conventional method for driving the PDP 20. Therefore, surface discharge between the scanning electrode 9 and the sustaining electrode 10 starts at time Tfsw2 which is later than the time Tfsw at which the surface discharge between the scanning electrode 9 and the sustaining electrode 10 in the conventional method for driving the PDP 20 starts.

Moreover, when it is assumed that a voltage to be applied to the scanning electrode 9 at the time Tfsw is "V(Tfsw)" and a voltage to be applied to the data electrode 6 at the time Tfm is "V(Tfm)", by determining the V(Tfsw), the V(Tfm) and Vsb so that a following expression holds, since facing discharge between the scanning electrode 9 and the data electrode 6 occurs earlier than surface discharge between the scanning electrode 9 and the sustaining electrode 10, as in the case of the first embodiment, feeble surface discharge between the scanning electrode 9 and the sustaining electrode 10 occurs in a stable manner:

$$V(Tfsw)-V(Tfm)<|Vsb|$$

Therefore, according to the fifth embodiment, it is possible to prevent intense discharge that occurs accidentally in the conventional method.

It is apparent that the present invention is not limited to the above embodiments but may be changed and modified without departing from the scope and spirit of the invention.

What is claimed is:

1. A method for driving a plasma display panel having a first substrate on which a plural of first electrodes and a plural of second electrodes are placed in parallel to each other, a plurality of display lines each being formed between one of said first electrodes and corresponding one of said second electrodes, and a second substrate on which a plural of third electrodes placed so as to face said plurality of first and second electrodes and formed in a manner that said plurality of said third electrodes is extended in a direction orthogonal to said plurality of said first and second electrodes, and a plurality of display cells placed at points of intersection of said plurality of said third electrodes and said plurality of said first and second electrodes, said method comprising:

a step of applying a voltage having an inclined waveform which changes with time to said first electrodes or/and said second electrodes; and a step of setting time of occurrence of discharge so that, in each of said display cells, time of occurrence of facing discharge between the first electrode or/and the second electrode to which said voltage having said inclined wave form is/are applied and the third electrode comes earlier than earliest time of occurrence of surface discharge between the first electrode and the second electrode corresponding to each other.

2. The method for driving a plasma display panel according to claim 1, wherein setting is done so that an electric potential of a pulse having said inclined waveform changes to become lower with time and an electric potential of said third electrode occurring when said pulse having said inclined waveform is applied is higher, for at least a partial period of time, than an electric potential of said third electrode occurring when a voltage of a pulse is applied before application of said voltage having said inclined waveform.

3. The method for driving a plasma display panel according to claim 2, wherein a negative bias voltage is applied to said third electrode when a voltage of a pulse is applied before application of said voltage having said inclined waveform.

4. The method for driving a plasma display panel according to claim 3, wherein, V(Tfsw), V(Tfm) and Vd2 (absolute value) are determined so that a following expression holds:

$$V(Tfsw)-V(Tfm)<Vd2$$

where V(Tfsw) denotes a voltage to be applied to said first electrode at time when discharge between said first electrode and said second electrode is started, V(Tfm) denotes a voltage to be applied to said first electrode at time when discharge between said first electrode and said third electrode is started, and Vd2 denotes a negative bias voltage to be applied to said third electrode.

5. The method for driving a plasma display panel according to claim 3, wherein, V(Tfss), V(Tfm) and Vd2 (absolute value) are determined so that a following expression holds:

$$V(Tfss)-V(Tfm)<Vd2$$

where V(Tfss) denotes a voltage to be applied to said first electrode at earliest time when intense discharge occurs, V(Tfm) denotes a voltage to be applied to said first electrode at time when discharge between said first electrode and said third electrode is started, and Vd2 denotes a negative bias voltage to be applied to said third electrode.

6. The method for driving a plasma display panel according to claim 2, wherein a positive bias voltage is applied to said third electrode while a voltage having said inclined waveform is being applied.

7. The method for driving a plasma display panel according to claim 6, wherein, V(Tfsw), V(Tfm) and Vd3 are determined so that a following expression holds:

$$V(Tfsw)-V(Tfm)<Vd3$$

where V(Tfsw) denotes a voltage to be applied to said first electrode at time when discharge between said first electrode and said second electrode is started, V(Tfm) denotes a voltage to be applied to said first electrode at time when discharge between said first electrode and said third electrode is started, and Vd3 denotes a positive bias potential to be applied to said third electrode.

8. The method for driving a plasma display panel according to claim 7, wherein said positive bias potential is applied at latest until time when said positive bias voltage reaches a voltage of start of discharge between said first electrode and said second electrode and, after that time, application of said positive bias voltage terminates.

9. The method for driving a plasma display panel according to claim 7, wherein said positive bias potential is lowered after occurrence of discharge between said first electrode and said second electrode.

10. The method for driving a plasma display panel according to claim 7, wherein said positive bias potential is at a same potential as a potential to be applied during a selection period during which displaying of a display cell is controlled.

11. The method for driving a plasma display panel according to claim 7, wherein said negative bias potential is at a same potential as a potential to be applied during a selection period during which displaying of a display cell is controlled.

12. The method for driving a plasma display panel according to claim 1, further comprising:

a step of setting a potential of said first electrode or said second electrode to which no voltage having said inclined waveform is applied so that a potential of said pulse having said inclined waveform to be applied to either said first electrode or said second electrode changes to become lower with time and so that, start time of discharge between said first electrode and said second electrode, during a period while a voltage having said inclined waveform is being applied, comes later than start time of discharge between electrodes to which said voltage having said inclined waveform is applied and said third electrode.

13. The method for driving a plasma display panel according to claim 12, further comprising a step of applying a voltage having said inclined waveform to said first electrode and a first voltage being lower than a voltage to be applied to said first electrode at last time of sustaining discharge to said second electrode.

14. The method for driving a plasma display panel according to claim 13, wherein, V(Tfsw), V(Tfm) and Vsb (absolute value) are determined so that a following expression holds:

$$V(Tfsw)-V(Tfm)<Vsb$$

where V(Tfsw) denotes a voltage to be applied to said first electrode at time when discharge between said first electrode and said second electrode is started, V(Tfm) denotes a voltage to be applied to said first electrode at time when discharge between said first electrode and said third electrode is started, and Vsb denotes a potential difference between a voltage to be applied to said first electrode at last time of sustaining discharge and said first voltage.

15. The method for driving a plasma display panel according to claim 13, wherein a voltage having said inclined waveform is applied to put said display cell into a non-display state after termination of a sustaining period during which light is emitted by said display cell.

16. The method for driving a plasma display panel according to claim 1, wherein a voltage having said inclined waveform is applied to erase wall charges accumulated by application of a pre-discharging pulse following application of said pre-discharging pulse used to cause discharge of all display cells to forcedly occur.

17. The method for driving a plasma display panel according to claim 1, wherein setting is done so that an electric potential of a pulse having said inclined waveform changes to become higher with time and an electric potential of said third electrode occurring when said pulse having said inclined waveform is applied is lower, for at least a partial period of time, than an electric potential of said third electrode occurring when a voltage of a pulse is applied before application of said voltage having said inclined waveform.

18. The method for driving a plasma display panel according to claim 17, wherein a positive bias voltage is applied to said third electrode when a voltage of a pulse is applied before application of said voltage having said inclined waveform.

19. The method for driving a plasma display panel according to claim 18, wherein, V(Tfsw), V(Tfm) and Vd2 are determined so that a following expression holds:

$$|V(Tfsw)-V(Tfm)|<Vd2$$

where V(Tfsw) denotes a voltage to be applied to said first electrode at time when discharge between said first electrode and said second electrode is started, V(Tfm) denotes a voltage to be applied to said first electrode at time when discharge between said first electrode and said third electrode is started, and Vd2 denotes a positive bias voltage to be applied to said third electrode.

20. The method for driving a plasma display panel according to claim 18, wherein, V(Tfss), V(Tfm) and Vd2 are determined so that a following expression holds:

$$|V(Tfss)-V(Tfm)|<Vd2$$

where V(Tfss) denotes a voltage to be applied to said first electrode at earliest time when intense discharge occurs, V(Tfm) denotes a voltage to be applied to said first electrode at time when discharge between said first electrode and said third electrode is started, and Vd2 denotes a positive bias voltage to be applied to said third electrode.

21. The method for driving a plasma display panel according to claim 17, wherein a negative bias voltage is applied to said third electrode while a voltage having said inclined waveform is being applied.

22. The method for driving a plasma display panel according to claim 21, wherein, V(Tfsw), V(Tfm) and Vd3 are determined so that a following expression holds:

$$|V(Tfsw)-V(Tfm)|<Vd3$$

where V(Tfsw) denotes a voltage to be applied to said first electrode at time when discharge between said first electrode and said second electrode is started, V(Tfm) denotes a voltage to be applied to said first electrode at time when discharge between said first electrode and said third electrode is started, and Vd3 denotes a negative bias potential to be applied to said third electrode.

23. The method for driving a plasma display panel according to claim 21, wherein said negative bias potential is lowered after occurrence of discharge between said first electrode and said second electrode.

24. The method for driving a plasma display panel according to claim 1, further comprising:

a step of setting a potential of said first electrode or said second electrode to which no voltage having said inclined waveform is applied so that a potential of said pulse having said inclined waveform to be applied to either said first electrode or said second electrode changes to become higher with time and so that, start time of discharge between said first electrode and said second electrode, during a period while a voltage having said inclined waveform is being applied, comes later than start time of discharge between electrodes to which said voltage having said inclined waveform is applied and said third electrode.

25. The method for driving a plasma display panel according to claim 24, further comprising a step of applying a voltage having said inclined waveform to said first electrode and a first voltage being higher than a voltage to be applied to said first electrode at last time of sustaining discharge to said second electrode.

26. The method for driving a plasma display panel according to claim 25, wherein, V(Tfsw), V(Tfm) and Vsb are determined so that a following expression holds:

$$|V(Tfsw)-V(Tfm)|<Vsb$$

where V(Tfsw) denotes a voltage to be applied to said first electrode at time when discharge between said first electrode and said second electrode is started, V(Tfm) denotes a voltage to be applied to said first electrode at time when discharge between said first electrode and said third electrode is started, and Vsb denotes a potential difference between a voltage to be applied to said first electrode at last time of sustaining discharge and said first voltage.

27. The method for driving a plasma display panel according to claim 25, wherein a voltage having said inclined waveform is applied to put said display cell into a non-display state after termination of a sustaining period during which light is emitted by said display cell.

* * * * *